US006224183B1

(12) United States Patent
Kono et al.

(10) Patent No.: US 6,224,183 B1
(45) **Date of Patent: *May 1, 2001**

(54) INK-JET PRINTING APPARATUS AND FACSIMILE APPARATUS

(75) Inventors: Takeshi Kono, Kawasaki; Atsushi Saito, Yokohama; Takashi Ono, Yokosuka; Shinichiro Koori, Kawasaki; Yukio Nohata, Yokohama; Shigeyuki Sugiyama, Hiratsuka, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/651,891

(22) Filed: May 21, 1996

(30) Foreign Application Priority Data

May 22, 1995 (JP) ..... 7-122306
Mar. 6, 1996 (JP) ..... 8-049188

(51) Int. Cl.[7] ..... B41J 29/393
(52) U.S. Cl. ..... 347/19
(58) Field of Search ..... 347/35, 37, 19, 347/23

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/66 |
| 4,609,925 | * | 9/1986 | Nozo et al. | 347/27 |
| 4,709,244 | * | 11/1987 | Piatt et al. | 347/19 |
| 4,723,129 | | 2/1988 | Endo et al. | 347/45 |
| 4,740,796 | | 4/1988 | Endo et al. | 347/56 |
| 5,030,317 | | 7/1991 | Noguchi | 347/65 |
| 5,124,720 | * | 6/1992 | Schantz | 347/19 |
| 5,160,938 | * | 11/1992 | Fargo et al. | 347/19 |
| 5,455,608 | * | 10/1995 | Stewart et al. | 347/23 |
| 5,477,244 | | 12/1995 | Shibata et al. | 347/19 |
| 5,621,524 | * | 4/1997 | Mitani | 356/338 |
| 5,663,750 | * | 9/1997 | Sakuma | 347/7 |

FOREIGN PATENT DOCUMENTS

| | | |
|---|---|---|
| 3244112 | 5/1984 | (DE) . |
| 0110634 | 6/1984 | (EP) . |
| 0447262 | 9/1991 | (EP) . |
| 0470813 | 2/1992 | (EP) . |
| 54-56847 | 5/1979 | (JP) . |
| 59-123670 | 7/1984 | (JP) . |
| 59-138461 | 8/1984 | (JP) . |
| 60-71260 | 4/1985 | (JP) . |

* cited by examiner

*Primary Examiner*—John Barlow
*Assistant Examiner*—M. Brooke
(74) *Attorney, Agent, or Firm*—Fitzpatrick, Cella, Harper & Scinto

(57) ABSTRACT

In an ink-jet printing apparatus employing an ejection failure detecting construction for optically detecting the number of ink droplets interrupting a light path, when a power source for an apparatus is turned on, a home position is detected. A carriage is shifted from this point at a constant speed, and ink ejection is performed sequentially within zones P1 to P2 where a photosensor is present. Then, among variations of output of the photosensor by sequential ink ejection, the number of steps S of a motor up to a timing where the maximum output Vmax is output. In a subsequent process for detecting ejection failure, ejection is performed at this position.

36 Claims, 14 Drawing Sheets

INK-JET PRINTING APPARATUS AND FACSIMILE APPARATUS

BACKGROUND OF THE INVENTION

1. Field of the Invention

The present invention relates generally to an ink-jet printing apparatus to be employed in a facsimile apparatus, a printer, a copy machine and so forth. More specifically, the invention relates to a technology for detecting ejection failure caused by plugging of ejection openings in an ink-jet head or running out of an ink.

2. Description of Related Art

Various systems for performing printing on printing media, such as paper, OHP sheet and so forth have been known. Amongst, an ink-jet printing system is to directly eject an ink toward the printing medium. Such ink-jet system is advantageous in relatively low running cost and low in the level of noise to be generated associated with an operation thereof. On the other hand, in the ink-jet system, it becomes necessary to quickly detect running out of the ink by consuming all of the ink in an ink tank or ejection failure caused by plugging of ejection openings or so forth, to prevent printing failure from occurring, previously.

As an example of a construction for detecting such ejection failure, there has been known a method to perform printing operation of a mark for judgement of presence or absence of the ink on a printing medium, and to make judgement whether the mark is printed or not by means of a reflection type photosensor, in viewpoint of detection of remaining amount of the ink. However, this method requires printing of the mark which is actually unnecessary, only for detecting presence and absence of the ink. Therefore, the printing apparatus employing such method is not user friendly.

In the ink-jet printing apparatus, as a method for detecting faulty condition of ejection, such as running out of the ink, ejection failure due to plugging and so forth, there has been known a technology for passing the ejected ink droplet between a light emitting element and a photo-sensing element of a transmission type photosensor and detecting ejection failure based on whether the light between the elements is interrupted or not.

In one example of construction of the above-mentioned transmission type photosensor, a lens is integrally formed on a light emitting surface of the light emitting element. By this, substantially parallel light is projected toward the photo-sensing element. On the other hand, in a photo-sensing surface of the photo-sensing element, an aperture in the order of 0.7 mm×0.7 mm is formed on a light axis by a molding member. By this, in the overall range between photo-sensing and light emitting, detecting range is limited at approximately 0.7 mm in height and approximately 0.7 mm in width. Further, the light emitting element and the photo-sensing element are arranged so that a light axis extending therebetween is in parallel to ejection opening array of the ink-jet head and intersects with a flying path of the ejected ink droplet. Also, a distance between the light emitting element and the photo-sensing element is set to be wider than a range of the ejection opening array. By this, all of the ink droplets ejected from respective ejection openings of the ink-jet head may pass through the detection range between the light emitting element and the photo-sensing element. Thus, when the ink ejection is performed normally and the ink droplet passes the detection range, the ink droplet interrupts the light beam from the light emitting side to reduce the amount of light reaching at the photo-sensing side to cause variation of output of the photo-sensing element. The ejected ink droplet is a fine liquid droplet having a diameter less than or equal to 50 $\mu$m. Therefore, normally, a single ink droplet ejected from single ejection opening may not interrupt the light emitted from the light emitting side completely. Instead, light interruption ratio is gradually increased depending upon number of ejection openings ejecting ink. Accordingly, when the output of the transmission type photosensor varies in a magnitude greater than or equal to a given amount, ink ejection is judged as normal. Conversely, when the variation magnitude of the transmission type photosensor is less than or equal to the given amount, failure of ink ejection can be detected.

The above-described technology for detecting ejection failure may perform detection without adding any special parts for the ink-jet head. Therefore, it can be employed as effective means for detection of ejection failure.

When the ejection failure is to be detected in a manner set forth above, it becomes necessary to accurately position a light axis of the photosensor and the ejection opening array of the ink-jet head so that ink ejected from respective ejection openings may cross a light path of the photo sensor. In such case, basically, a shifting magnitude of the ink-jet head from a reference position to the position of the light axis is preliminarily set and positioning is performed by shifting the ink-jet head for the preliminarily set shifting magnitude.

However, due to variations of performance of respective components of a mechanism, which variations are caused when manufacturing the mechanism, for shifting of the head or due to fluctuation in ejection angle of the ink caused by a variation of performing of the ink-jet head, an ink droplet ejected from each ejection opening may be deviated from the light axis of the photosensor in a magnitude of 1 mm at the maximum, even when the positioning operation set forth above is performed. In view of a fact set forth above, the prior art is designed to perform ejection in a range of approximately 2 mm at both sides of the light axis, which range is greater than the range of deviation of the ejected ink droplet, upon detection of the ejection failure. Then, detection of ejection failure is performed by judging whether an output of the photosensor exceeds a predetermined amount when the ejection is performed, or not.

In the prior art as set forth above, since the ink is ejected in the range of approximately 2 mm at both sides of the light axis upon detection of ejection failure, the number of ink droplets to be ejected through each ejection opening becomes about 50 to 100. Therefore, when number of the ejection openings provided in the ink-jet head is, for example, 64, the overall number of the ink droplets to be ejected through respective of the ejection openings becomes about 3200 to 6400 to cause relatively large amount of ink consumption. As a result, the running cost of the ink-jet printing apparatus is raised.

Further, in the case that relatively large tolerance is given for respective components of an ink jet apparatus for lowering of production cost of the ink-jet printing apparatus, the fluctuation in positioning between the light axis and the head becomes further greater so that it becomes necessary to widen the range in which the ejection for detection of the ejection failure needs to be performed. Therefore, ink consuming condition becomes worse.

SUMMARY OF THE INVENTION

It is an object of the present invention to provide an ink-jet printing apparatus which can remarkably reduce ink amount to be used for detection of ejection failure even when precision of respective components relating to positioning between a photosensor and an ink-jet head is not so high.

Another object of the present invention is to provide an ink-jet printing apparatus which can detect relationship between a detecting means and the ink-jet head in position by performing ink ejection within a predetermined range and on the basis of a distribution of an output of the detecting means, and whereby a range of performing ejection of the ink upon detection of the ejection failure can be minimized.

A further object of the present invention is to provide an ink-jet printing apparatus which can satisfactorily detect ejection failure even when offset of the ejecting position relative to the photosensor is present upon detection of ejection failure due to tolerance of the components, use environment and period, individual difference of the ink-jet head or so forth.

In a first aspect of the present invention, there is provided an ink-jet printing apparatus employing an ink-jet head having a plurality of ejection openings to perform printing by ejecting an ink toward a printing medium, comprising:

detecting means having a light emitting element and a photosensing element;

moving means for moving the ink-jet head and the detecting means relatively to each other;

ejection control means for making the moving means to relatively move the detecting means and the ink-jet head and for, during relative movement of the detecting means and the ink-jet head, performing ejection from the ink-jet head within a predetermined first moving range including a light path formed between the light emitting element and the photosensing element;

range determining means for determining a second moving range included in the first moving range on a basis of output of the detecting means varying depending upon ink ejection from the ink-jet head within the first shifting means; and ejection failure detecting means for making the moving means to relatively move the ink-jet head and the detecting means, for performing ejection from the ink-jet head within the second moving range during relative movement of the ink-jet head and the detecting means, and for detecting ejection failure of the ejection opening on a basis of output of the detecting means upon ejection performed within the second moving range.

In a second aspect of the present invention, there is provided an ink-jet printing apparatus for performing printing by ejecting an ink from an ink-jet head toward a printing medium, comprising:

an ink tank storing the ink, the ink tank being exchangeably provided in the ink-jet printing apparatus;

scanning means for reciprocally scanning the ink-jet head;

detecting means for making the ink-jet head to perform ejection of ink and performing detection of an ink amount in the ink tank;

control means for moving the ink-jet head in the vicinity of a nominal detecting position of the detecting means and controlling operation of the detecting means at respective of a plurality of positions in the vicinity of the nominal detecting position; and correcting means for correcting a position at which the detecting means performs the detection on a basis of a result of detection obtained from the detecting means at respective of the plurality of positions.

In a third aspect of the present invention, there is provided a facsimile apparatus for performing printing output on a basis of received data by employing an ink-jet head having a plurality of ink-jet openings, comprising:

detecting means having a light emitting element and a photosensing element;

moving means for moving the ink-jet head and the detecting means relatively to each other;

ejection control means for making the moving means to relatively move the detecting means and the ink-jet head and for, during relative movement of the detecting means and the ink-jet head, performing ejection from the ink-jet head within a predetermined first moving range including a light path formed between the light emitting element and the photosensing element;

range determining means for determining a second moving range included in the first moving range on a basis of output of the detecting means varying depending upon ink ejection from the ink-jet head within the first shifting means; and ejection failure detecting means for making the moving means to relatively move the ink-jet head and the detecting means for performing ejection from the ink-jet head within the second moving range during relative movement of the ink-jet head and the detecting means, and for detecting ejection failure of the ejection opening on a basis of output of the detecting means upon ejection performed within the record moving range.

In a fourth aspect of the present invention, there is provided a facsimile apparatus for performing printing output on the basis of received data employing an ink-jet head having a plurality of ink ejection openings, comprising:

an ink tank storing the ink, the ink tank being exchangeably provided in the ink-jet printing apparatus;

scanning means for reciprocally scanning the ink-jet head;

detecting means for making the ink-jet head to perform ejection of ink and performing detection of an ink amount in the ink tank;

control means for moving the ink-jet head in the vicinity of a nominal detecting position of the detecting means and controlling operation of the detecting means at respective of a plurality of positions in the vicinity of the nominal detecting position; and correcting means for correcting a position at which the detecting means performs the detection on a basis of a result of detection obtained from the detecting means at respective of the plurality of positions.

In a fifth aspect of the present invention, there is provided a detection position correcting method for a ink-jet printing apparatus employing an ink-jet head having a plurality of ejection openings to perform printing by ejecting an ink toward a printing medium, the method comprising the steps of:

moving the ink-jet head and detecting means having a light emitting element and a photosensing element relatively to each other;

during relative movement of the detecting means and the ink-jet head, performing ejection from the ink-jet head within a predetermined first moving range including a light path formed between a light emitting element and a photosensing element;

determining a second moving range included in the first moving range on a basis of output of the detecting means varying depending upon ink ejection from the ink-jet head within the first shifting means; and moving the ink-jet head and the detecting means, performing ejection from the ink-jet head within the second moving range during relative movement of the ink-jet head and the detecting means, and detecting ejection failure of the ejection opening on a basis of output of the detecting means upon ejection performed within the record moving range.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiment of the present invention will be discussed hereinafter in detail with reference to the accompanying drawings. Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

(First Embodiment)

Figure 1:
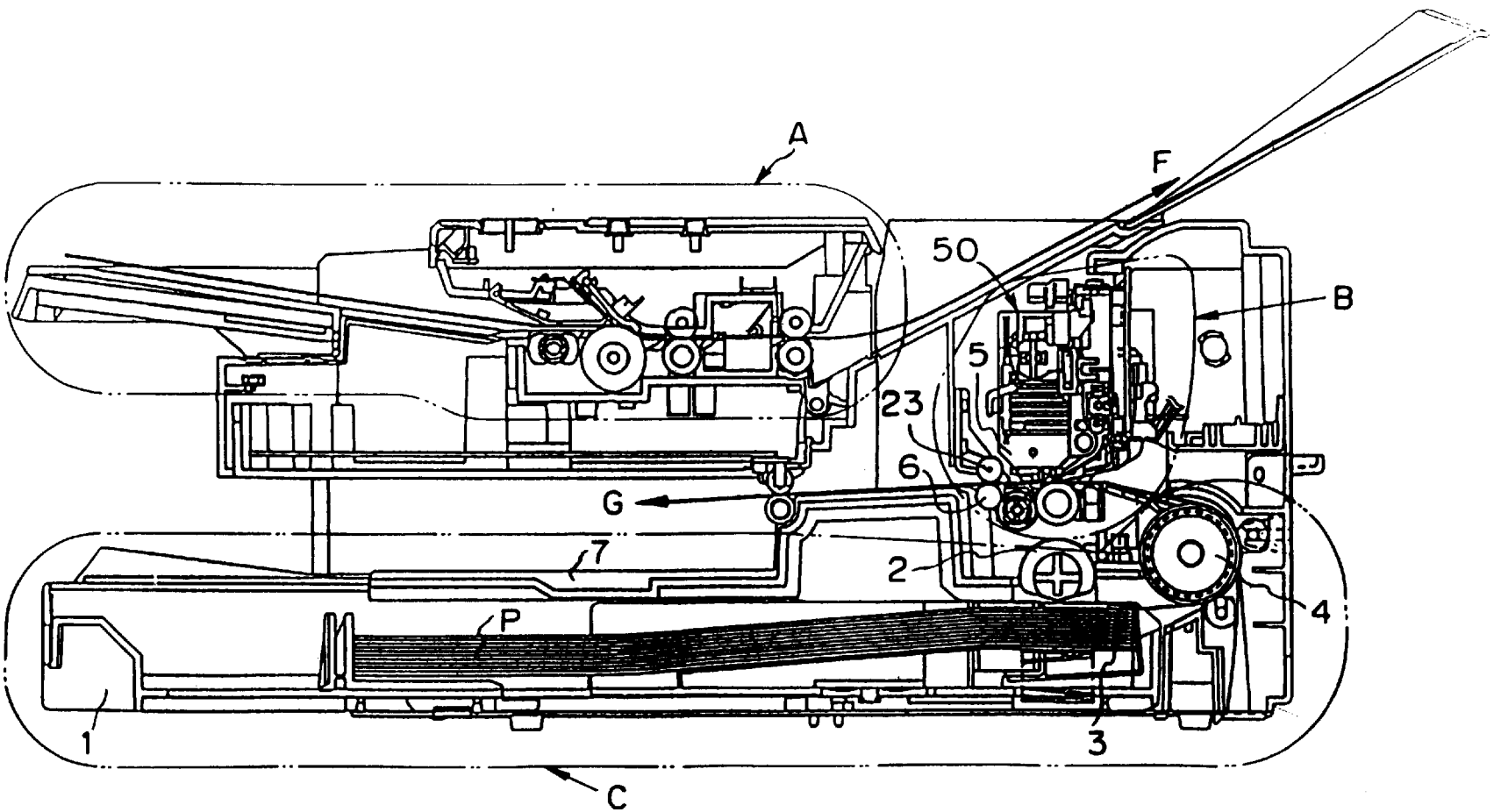
FIG. 1 is a section as viewed from a side of one embodiment of a facsimile apparatus according to the present invention.

FIG. 1 is a section showing one embodiment of a facsimile apparatus, in which the present invention is applied.

At first, discussion will be given for general construction of the facsimile apparatus with reference to FIG. 1. In FIG. 1, a reference sign A denotes a reading portion for optically reading an original, a reference sign B denotes a printing portion employing an ink-jet printing apparatus, a reference sign C denotes a feeder portion separating a sheet, such as printing paper or so forth stacked in a sheet cassette and supplying the sheet to the printing portion B. It should be noted that a mechanical construction of respective parts are similar to those known in the art.

A transporting path of a printing paper P is as shown by arrow G. More specifically, the printing paper P stacked in a feeder cassette 1 of the feeder portion C is picked up by a feeder roller 2 and a separation claw 3 and fed into the printing portion B by a transporting roller 24 as transporting means. In the printing portion B, ink is ejected from an ink-jet head 5 for performing printing. Subsequently, after transporting a certain distance within the apparatus, the printed paper is discharged and stacked in a discharge paper stacker 7 by a discharge roller 6.

Next, discussion will be given for detailed construction of the printing portion B with reference to FIG. 2.

Figure 2:
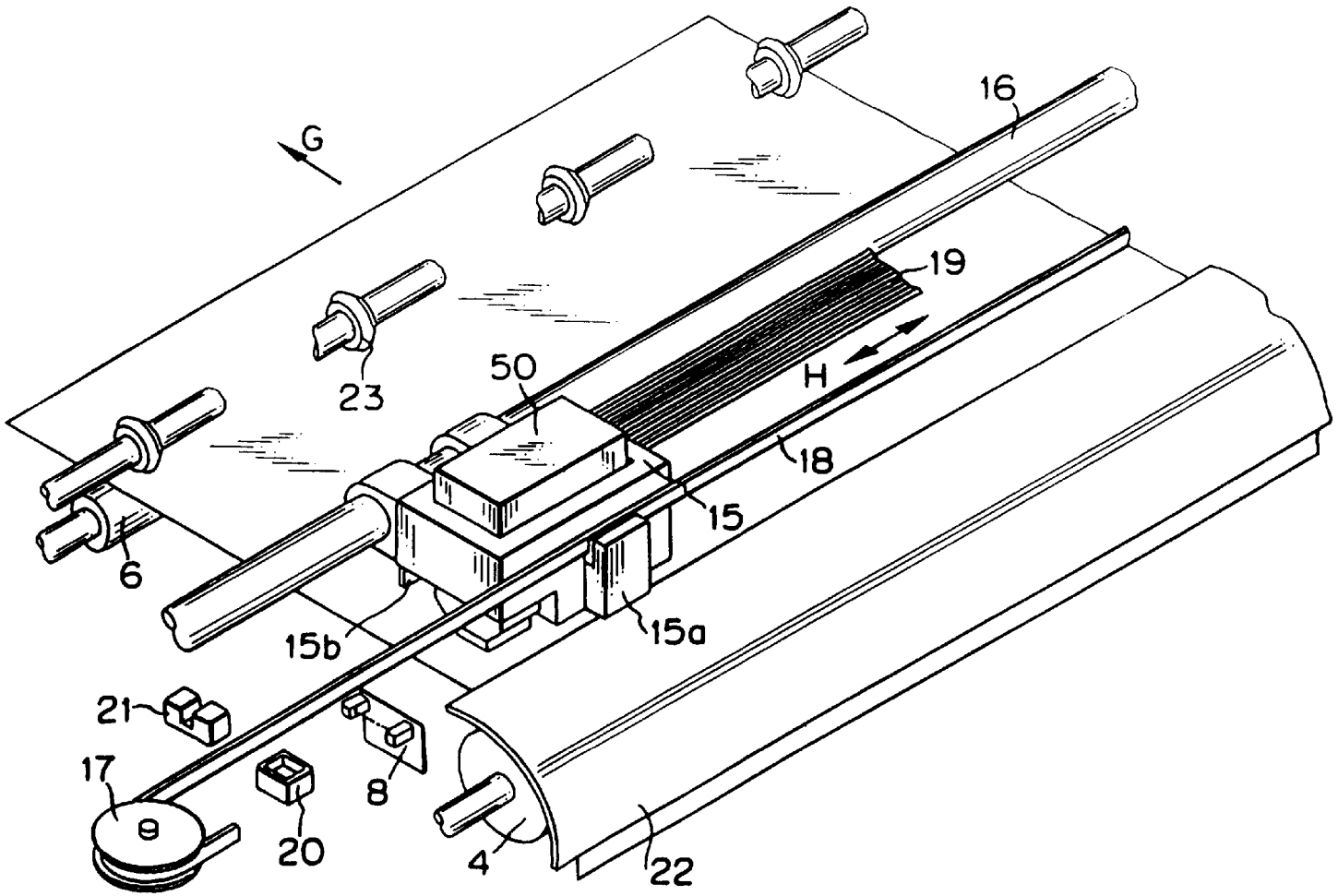
FIG. 2 is a perspective view showing detail of a printing portion in the facsimile apparatus of FIG. 1.

In FIG. 2, the shown embodiment of the ink-jet head 5 (not shown in FIG. 2) is the type formed integrally with an ink tank for replacement together with the ink tank when ink in the tank has run out. Namely, the ink-jet head and the ink tank construct an ink-jet cartridge 50 of the type of cartridge. The ink-jet head 5 arranges 64 ejection openings in one row at a density of 360 DPI. Electro-thermal transducing elements are arranged in respective of ink passages corresponding to respective ejection openings. Heat generation of the electro-thermal transducing element causes film boiling to generate a bubble so that ink is ejected through the ejection opening by pressure of the bubble.

A carriage 15 detachably mounting the ink-jet cartridge 50 is slidably held by a guide bar 16 and abutting portion 15*a* for reciprocal movement in a direction perpendicular to the transporting direction (the transporting direction is called auxiliary scanning direction, and shown by an arrow G in FIG. 2), namely in a primary scanning direction (shown by an arrow H in FIG. 2). Reciprocal motion of the carriage 15 is performed by means of a pulley 17 driven by a carriage motor 30 (see FIG. 3) and a timing belt 18 wound therearound. At this time, an ejection signal and an electric power to be supplied to the ink-jet head 5 are supplied from an electrical circuit or so forth in a main body of the facsimile apparatus through a flexible cable 19.

Further, a cap 20 is arranged at a position corresponding to a position of the carriage 15 in stand-by state (a home position) and moves up and down as required to cover a surface of the ink-jet head 5 where the ejection openings are provided at the upwardly moved position for avoiding of evaporation of ink and deposition of dust. Here, control of relative position between the ink-jet head 5 and the cap 20 in the primary direction is performed with employing a carriage home sensor 21 and a light shielding plate 15*b* provided on the carriage 15. As the carriage home sensor 21 and a transmission type photo-interrupter is employed. When the carriage 15 is moved to the stand-by position (home position), a part of a light irradiated from the carriage home sensor 21 is interrupted by the light shielding plate 15*b*. Utilizing this, the predetermined position where the ink-jet head 5 and the cap 20 are mutually opposing is detected.

The printing paper P is fed upwardly from the lower side of the printing portion in the drawing. Then, the printing paper P is deflected into the horizontal direction by the transporting roller 4 and a paper guide 22 to be transported in the direction of arrow G. The transporting roller 4 and the discharge roller 6 are respectively driven by a feeder motor 31 (see FIG. 3) for feeding the printing paper in the direction of arrow G at high precision in synchronism with reciprocating motion of the carriage 15. Spurs 23 are arranged at a plurality of positions opposing to the discharge roller 6 by an unknown bearing member with a given interval in a direction parallel to the primary scanning direction so that they may guide and transport the printing paper immediately after printing without affecting the printed image even when they contact with non-fixed image. Therefore, the spurs 23 are formed of a material having high water repelling characteristics and designed to contact with the printing paper P only at a teeth like peripheral portion.

A photosensor 8 is arranged at a position between the cap 20 and one end of the printing paper P to be transported and corresponding to the range where the ejection opening array of the ink-jet head 5 passes. The photosensor 8 is a transmission type photo-interrupter capable of optically detecting the ink droplet ejected from each ejection opening of the ink-jet head 5. Ink ejection failure of the ink-jet head can be judged on the basis of the output of the photosensor 8.

The photosensor 8 to be employed in the shown embodiment uses an infrared ray LED as the light emitting element. On the light emitting surface of the LED, a lens is formed integrally. By this, a substantially parallel light beam can be projected. As the photo-sensing element of the photosensor 8, a photo-transistor is employed. On a photo-sensing surface of the photo-sensing element is formed an aperture of 0.7 mm×0.7 mm on the light axis, by a molding method. Thus, in overall range between photo-receiving and light emitting, a detection range is restricted at 0.7 mm in height and 0.7 mm in width. Further, the light emitting element and the photo-sensing element are arranged so that a light axis extending therebetween is parallel to the ejection opening array of the ink-jet head and so that the distance between the light emitting element and the photo-sensing element becomes greater than the range of the ejection opening array of the ink-jet head 5. By this, when the ejection opening array of the ink-jet head 5 is positioned corresponding to the light axis, all of ink droplets ejected from respective ejection openings may pass the detection range between the light emitting element and the photo-sensing element. Thus, the photosensor 8 may output a value corresponding to number of ink droplets, namely number of ejection openings normally ejecting.

As set forth above, the photosensor 8 to be employed in the shown embodiment is the one similar to that discussed with respect to the prior art. Accordingly, due to fluctuation of characteristics of the photo-sensing element and the light emitting element of the sensor, play in assembling of these elements, and so forth, the sensor may have an error in output in the order to 20% at the maximum.

It should be noted that control of relative position between the ejection opening array of the ink-jet head and the light axis of the photosensor 8 is performed by employing a carriage home sensor 21 provided in the main body of the apparatus similar to positioning with the cap 20, set forth above. More specifically, a predetermined distance for shifting from the home position detected by the sensor 21 to the light axis of the photosensor is converted into number of steps of the motor for driving the carriage and preliminarily set the number of steps as a constant value in a sequence.

Next, discussion will be given for the major part of an electric circuit of the preferred embodiment of a facsimile apparatus with reference to a block diagram of FIG. 3.

Figure 3:
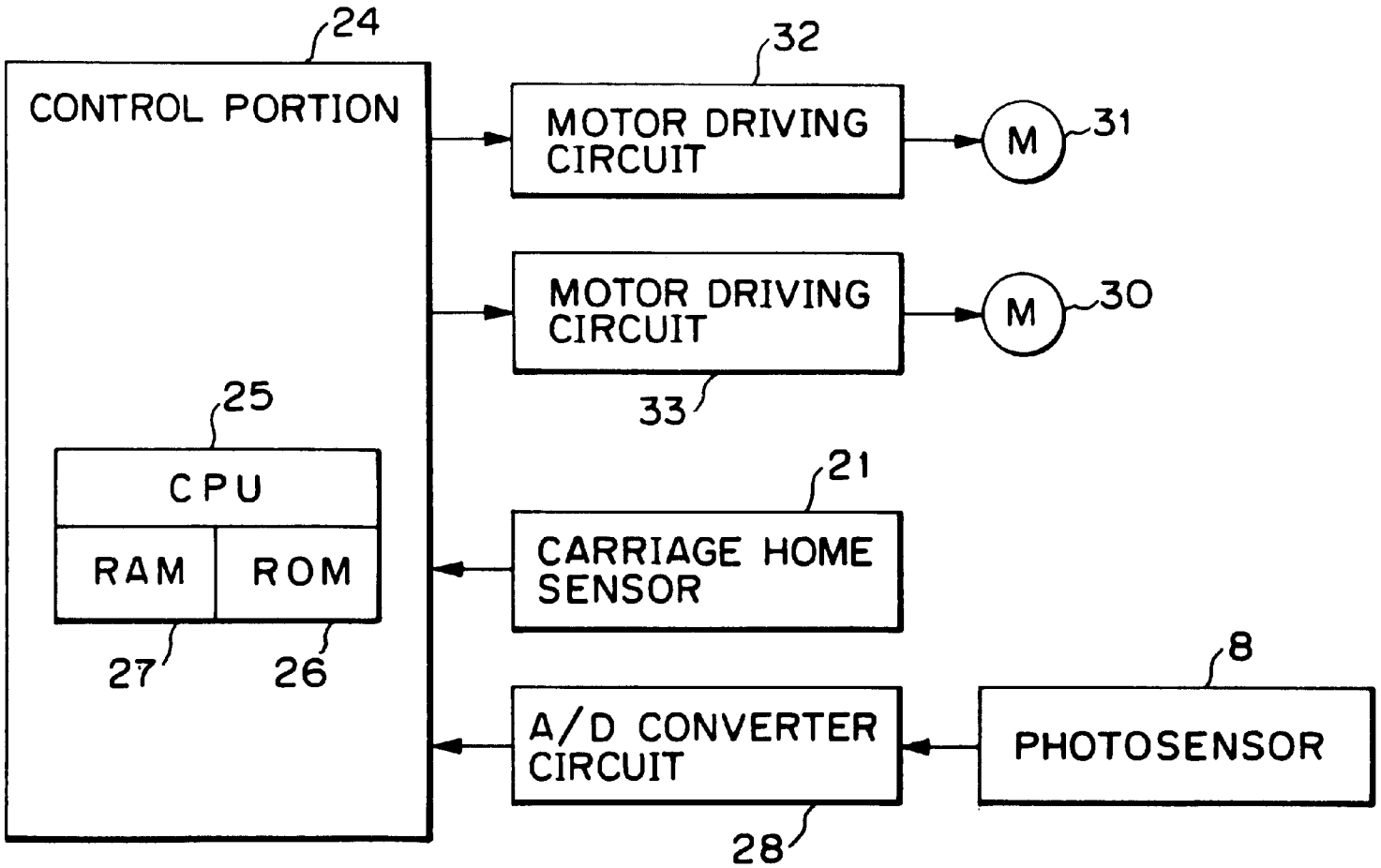
FIG. 3 is a block diagram showing a construction of a control system of the facsimile apparatus of FIG. 1.

In FIG. 3, a reference numeral 24 denotes a control portion controlling overall the facsimile apparatus. The control portion 24 includes CPU 25, such as a microprocessor and so forth, ROM 26 for storing control programs to be executed by the CPU 25 and various data, RAM 27 to be used as work area of the CPU 25 and temporarily storing various data, and so forth. The control portion is formed as a circuit on a substrate in the apparatus. An output of the photosensor 8 is converted into a digital value by an A/D converter and can be subjected to processing of the CPU 25. The carriage motor 30 and the feeder motor 31 are motors which can be controlled to a rotation angle by number of pulse steps issued by motor driver circuits 33 and 32, respectively, so that the CPU 25 can control rotation of motors 30 and 31. The output of the carriage home sensor 21 is input to the control portion 24 and used for controlling shifting of the ink-jet head.

Figure 4:
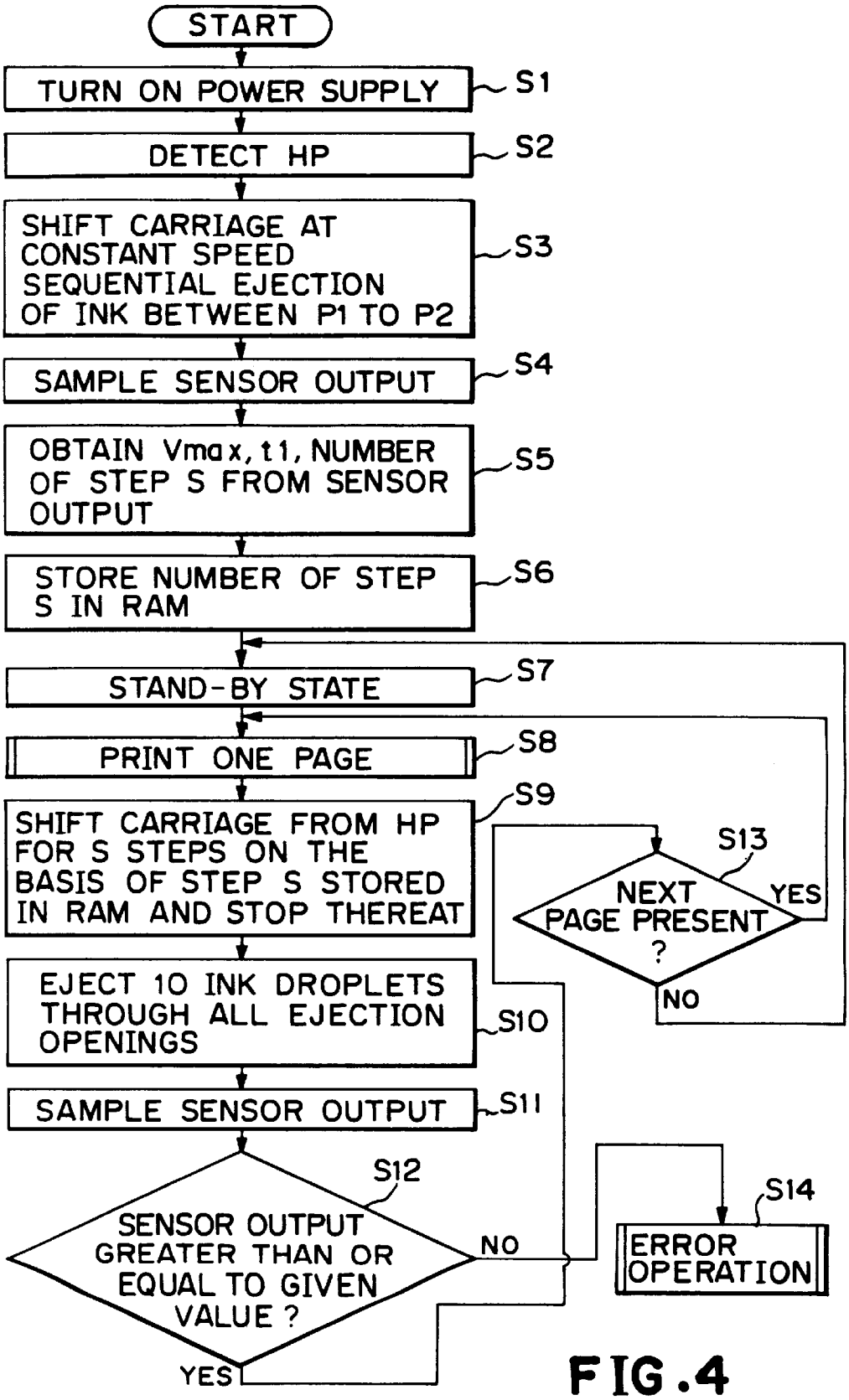
FIG. 4 is a flowchart showing a procedure of a first embodiment of a process relating to detection of ejection failure according to the present invention.
Figure 5:
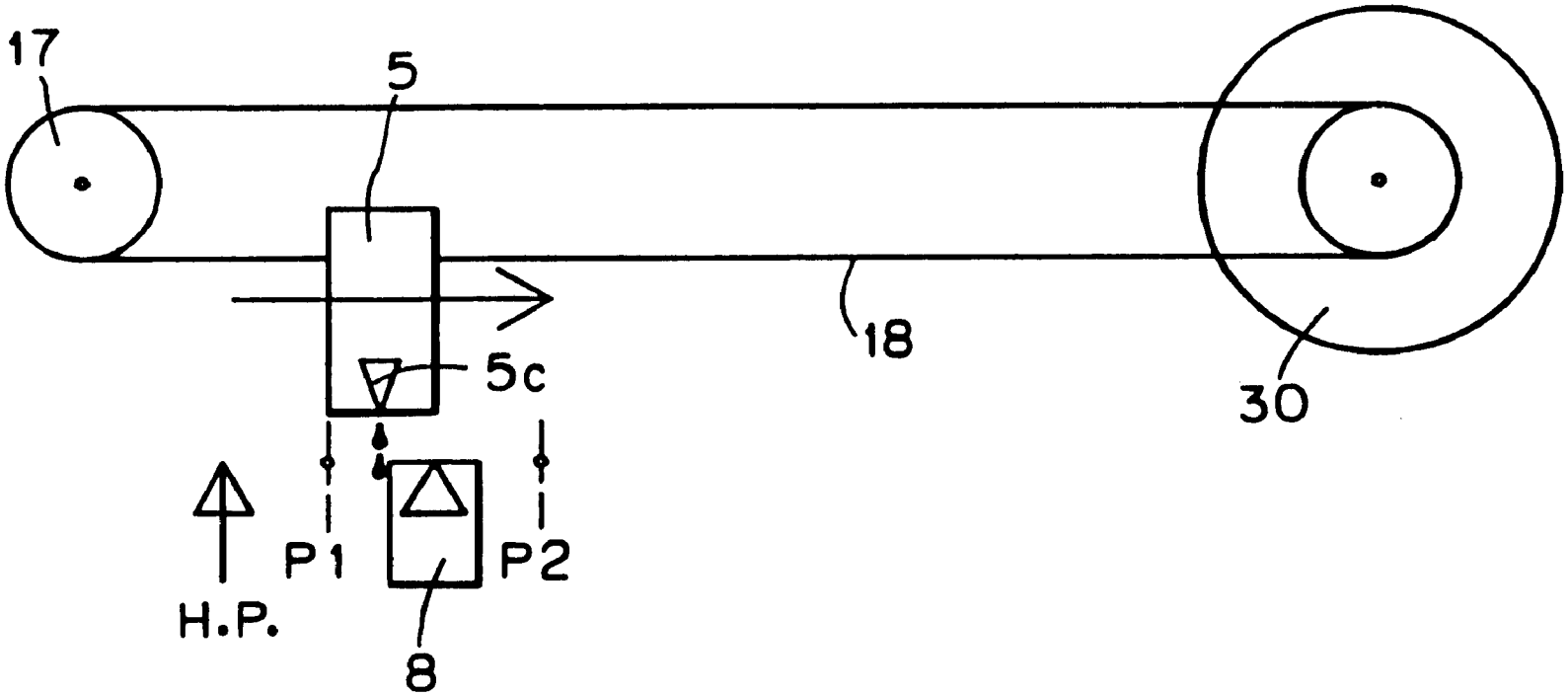
FIG. 5 is a diagrammatic illustration showing a construction of the first embodiment for processing detection of ejection failure of FIG. 4.
Figure 6:
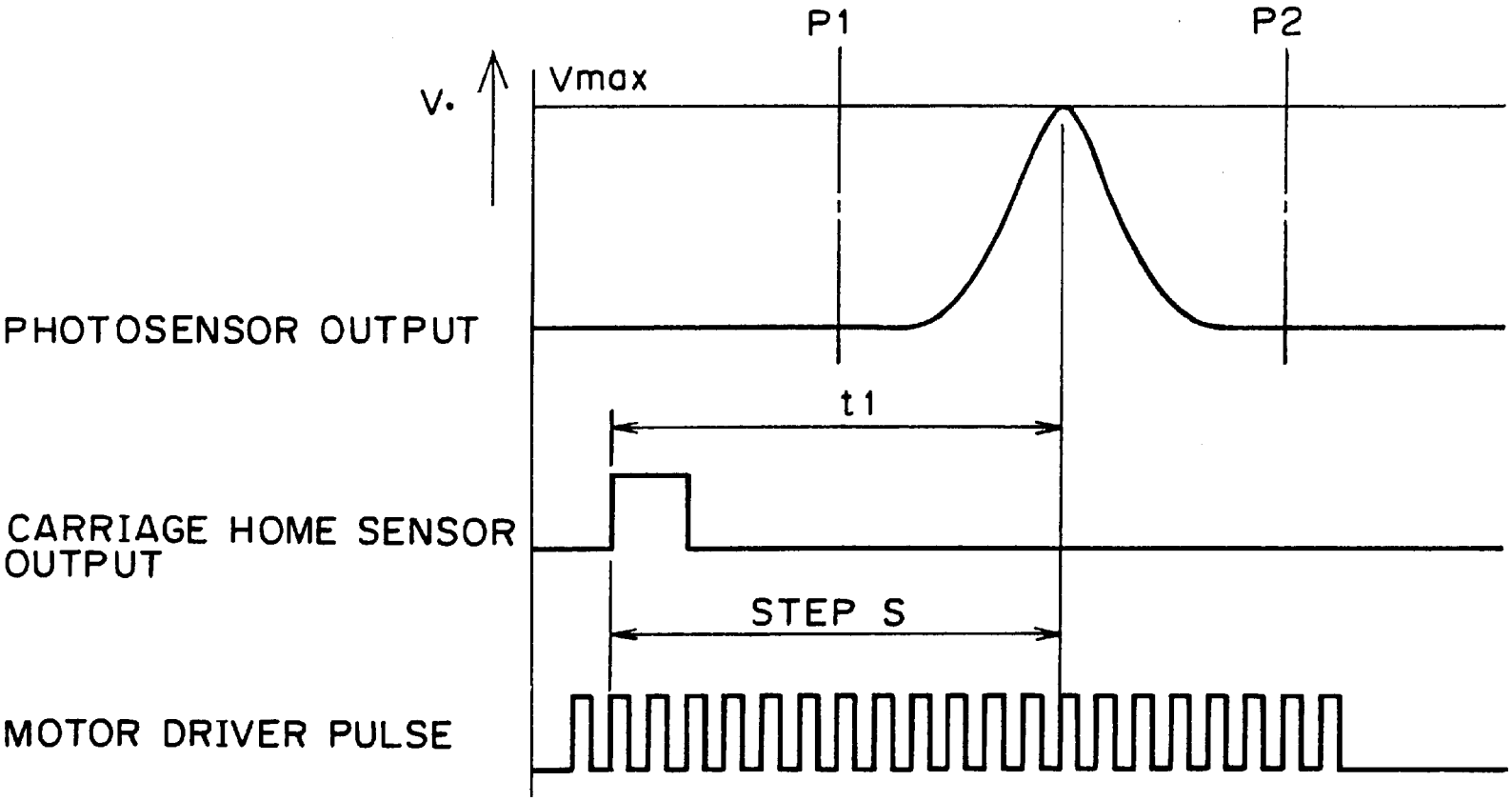
FIG. 6 is a timing chart showing the first embodiment of the ejection failure detecting process of FIG. 4.

FIG. 4 is a flowchart showing a sequence relating to detection of ejection failure on a basis of the above-mentioned construction of the shown embodiment, FIG. 5 is a diagrammatic illustration showing a construction in the shown embodiment of the apparatus relating to detection of ejection failure, and FIG. 6 is a timing chart of the foregoing sequence. The shown embodiment of process for detection of ejection failure will be discussed hereinafter with reference to these figures.

Upon turning ON of power supply for the facsimile apparatus (step S1), the carriage 15 is moved to detect the home position of the carriage 15 by a carriage home sensor 21 (step S2). Next, by moving carriage at a constant speed (approximately 300 mm/sec) from the home position, ink is ejected sequentially at a frequency of 6 kHz through all of the ejection openings while moving the head 5 within a range of approximately 4 mm from a predetermined position P1 approximately 2 mm ahead of reaching the position of the ejection opening array 5*c* of the ink-jet head 5 at the detecting position of the photosensor 8, to a predetermined position P2 approximately 2 mm beyond the detecting position, and thereafter the carriage is stopped, as shown in FIG. 5 (step S3). Here, the number of ejections of the ink is determined depending upon the moving speed of the carriage and ejecting range. 80 droplets are ejected from respective ejection openings.

During sequential ejection, outputs of the photosensor 8 are sampled at fine time interval (100 $\mu$sec) via the A/D converting circuit 28 (step S4). Furthermore, a maximum value Vmax which is a maximum value of output distribution of the photosensor on a basis of the sampled data and a period t1 for moving the carriage from the home position to the position outputting the Vmax are derived. Then, on a basis of the carriage speed and the period t1, number of steps S of the carriage motor 30 needed for moving the head from the home position to the position outputting the Vmax is derived (step S5, see FIG. 6). The number of steps S thus derived is stored in RAM 27 (step S6). Then, the apparatus is placed in stand-by state until a printing command is input (step S7).

In response to the printing command, the printing paper P is picked up and fed to the printing portion B. Then, printing for one page of image data is performed (step S8). Whenever printing for one page is completed, an operation for detecting ejection failure due to running out of the ink, plugging of the ejection openings or so forth is performed. More specifically, at first, with reference to the data of number of steps S stored in RAM 27, the carriage 15 is moved to the position corresponding to the number of steps S of the carriage motor 30 from the home position and stopped thereat (step S9). By this movement of the carriage, the position of the ejection opening array 5*c* of the ink-jet head 5 corresponds to the light axis of the photosensor 8 so that the ejected ink droplet may fly across the light path of the sensor 8.

It should be noted that, in the shown embodiment, this relationship in position is basically maintained unless the ink-jet head or the component of the apparatus is exchanged. However, it may be possible to perform process for deriving the number of steps S upon ON-set of power supply for the apparatus for more precise re-set. Also, by this, even when a relationship between the number of steps S and the actually detected position changes at respective portion of the apparatus with time, such offset can be adjusted. It should be noted that, upon obtaining distribution of the outputs of the photosensor 8, it is possible that a part of a plurality of the ejection openings causes ejection failure. However, since appropriate positional relationship between the head and the photosensor is established at the position where the output distribution becomes maximum, no significant problem will arise. Further, it is also possible to make the number of steps S to correspond to a narrower range between P1 to P2 rather than to correspond to one point, for performing the following process.

Next, ejection is performed through all of the ejection openings of the head for ejecting respective 10 ink droplets (step S10). During this ejection, the outputs of the photosensor 8 are sampled in the similar process to that of step S4 (step S11). Then, on a basis of the sampled data, an error operation is performed (step S14) under judgement that ejection failure is caused when the output of the photosensor 8 does not reach the given value (step S12). For example, a received data is stored in a memory, an error display is output and printing operation is terminated. On the other hand, when judgement is made that the output of the sensor 8 is greater than or equal to the given value and the next page to be printed is present (steps S12 and S13), picking up of next printing paper is initiated to repeat the similar operation. If data for the next page is not present, the apparatus returns to the stand-by state at step S9 (step S13).

It should be noted that, as set forth above, even in the process to obtain the appropriate positional relationship between the head and the photosensor, ink ejection is performed in wider range in certain extent to consume the ink. However, since this process is performed only at ON-set of power supply, and in case of the shown embodiment, subsequently performed ejection for detecting ejection failure is performed only at the position determined in the process set forth above for each page. Therefore, the ink consuming amount can be much smaller than that in the prior art.

It should be noted that while the foregoing construction has been discussed with respect to an example for performing high speed sampling by employing the A/D converting circuit, it is also possible to employ a comparator circuit constituted of a relatively inexpensive operational amplifier instead of employing the A/D convertor, to set a given threshold value for the output value of the sensor, to measure a period by causing interruption in the control portion at a timing where the sensor output exceeds the threshold valve and at a timing where the sensor output drops below the threshold value, and to approximate the intermediate point between the foregoing two timings as the time t1, at which the maximum value is obtained.

Next, a principle of ejection of the ink-jet head to be employed in the printing portion in the shown embodiment of the ink-jet printing apparatus will be discussed.

The ink-jet head generally has a fine liquid ejection opening (orifice), a liquid passage (ink passage), an energy acting portion providing in a part of the liquid passage and an energy generating element for generating thermal energy to act on the liquid in the energy acting portion. The ink-jet head is replaceably provided for the carriage.

As other energy generating elements for generating energy, one employing an electromechanical transducer, such as piezoelectric element, one irradiating an electromagnetic wave, such as laser or so forth to be absorbed by the liquid presenting therein to cause generation of heat and thus eject liquid droplet by action associated with heat generation to fly the liquid droplet, and so forth are known. Amongst, a system for ejecting the liquid by a thermal energy generated by an electrothermal transducing element as employed in the shown embodiment, is suitable for high resolution printing since the liquid ejection openings (orifices) can be arranged at high density.

Further, the ink-jet head employing the electrothermal transducing element is easy to reduce a whole size, can take advantage of IC technology and/or micro-processing technology which are remarkable in advance of technology and in improvement of reliability in a recent semiconductor field, is satisfactorily effective, and is easily to make into elongated or flat (two-dimensional) configuration to permit increasing number of ejection openings to easily achieve high package density. Furthermore, such ink-jet head has high mass-productivity and thus can be supplied at low production cost.

Such ink-jet head employing the electrothermal transducing element as the energy generating means and produced through semiconductor fabrication process generally has a construction, in which liquid passages are provided corresponding to respective ink ejection openings, the electrothermal transducing element as means for forming liquid droplet to fly by ejecting the liquid through the corresponding ink ejection opening by applying the thermal energy for the liquid filling respective liquid passages independently of each other. To respective liquid passages, the liquid is supplied from a common liquid chamber communicated with respective liquid passages.

Concerning production method of the ink-jet head, the assignee of the present application has proposed a method, in which at least a solid layer for forming the liquid passage, an active energy beam setting material layer to be at least used in formation of a peripheral wall of the liquid passage and a second substrate are stacked on a first substrate in order, thereafter, a mask is formed on the second layer to irradiate an active energy beam from the upper side of the mask for consolidating at least the portion forming the peripheral wall of the active energy beam setting material, further, the non-solidified portion of the active energy beam setting material layer is removed from the region between two substrates to form at least the liquid passages (see U.S. Pat. No. 5,030,317).

Figure 7:
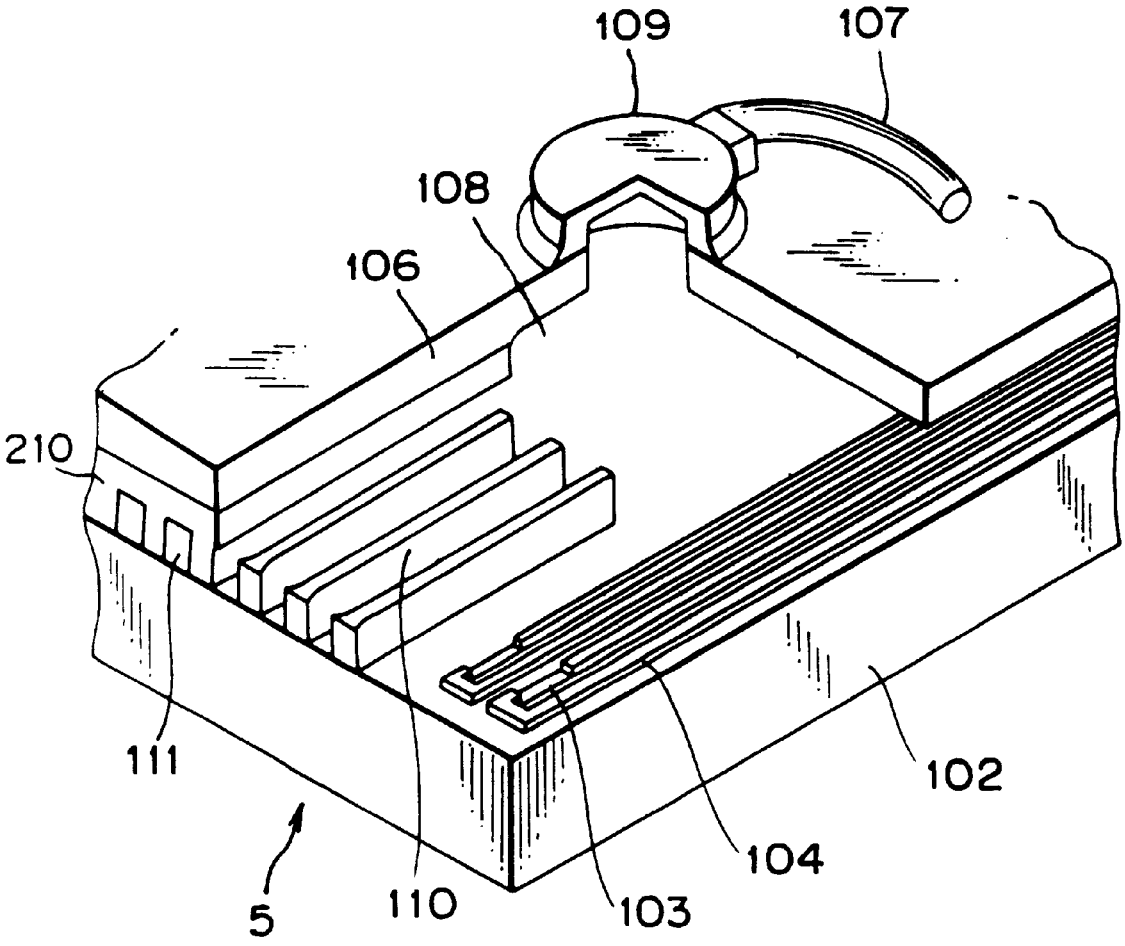
FIG. 7 is a partially sectioned perspective view showing a construction of an ink-jet head to be employed in embodiments of the invention.

FIG. 7 is a partially sectioned perspective view showing the internal structure of the ink-jet head 5 to be employed in the shown embodiment.

The ink-jet head 5 is formed with electrothermal transducers by depositing heating resistors 103 and electrodes 104 on a substrate 102 through semiconductor fabrication process, such as etching, deposition, sputtering and so forth. On the substrate 102, the active energy beam setting resin layer 210 having the liquid passage 110 and an upper plate 106 are laminated. The common liquid chamber 108 formed by lamination of the foregoing elements is adapted to temporarily store the ink to be supplied to respective liquid passages. In turn, the ink is supplied to the common liquid chamber 108 from an ink tank (not shown) through a liquid supply tube 107. On the other hand, 109 denotes a connector for connection with the liquid supply tube.

The ink supplied to the common liquid chamber 108 is supplied to each individual liquid passage 110 by capillary effect and is held stably by formation of meniscus at the ink ejection opening 111 at the tip end of the liquid passage. When power is supplied to the heating resistor 103 in such condition, the ink on the heating resistor 103 is heated to cause bubbling by film boiling. Then, by growth of the bubble, a liquid droplet is ejected through the ink ejection opening 111.

It should be noted that while the ink is ejected from all of the ejection openings (64 ejection openings) at step S4 in the first embodiment of the sequence for detecting ejection failure, it is possible to obtain the optimal positional relationship of the ink jet head and the photosensor by causing ejection through a part of ejection openings. Here, a part of ejection openings, for example, means first to sixteenth ejection openings out of 64 ejection openings. By limiting only these ejection openings, the ink consuming amount can be further reduced as intended by the present invention to lower running cost.

It should be noted that when the output of the photosensor does not reach the predetermined amount in the case that a part of the ejection openings are used, namely when it is possible that ejection failure is potentially caused in a part of the ejection openings, it is possible to derive the foregoing positional relationship with employing another part of the ejection openings.

Further, even when the optimal positional relationship between the head and the photosensor is derived with utilizing a part of the ejection openings at every time of process for detecting the ejection failure, the ink consuming amount can be still restricted to less than that in the prior art.

As set forth above, according to the first embodiment as set forth above, the positional relationship between the photosensor and the ink-jet head can be obtained on a basis of the distribution of the output of the photosensor by performing ejection of ink within a predetermined first range. Therefore, the range of ink ejection in the process of detection of ejection failure can be performed within a second range which is the minimum range. As a result, even when precision in positioning of the detecting means, such as the photosensor or so forth and the head is not so high, ink ejection failure can be certainly detected with reduced amount of ink consumption.

(Second Embodiment)

In the first embodiment set forth above, the distribution of the output of the photosensor is derived by sequentially performing ejection with moving the head within the predetermined range in the process for determining the position to perform ejection for detecting the ejection failure, whereas in the second embodiment, the distribution of the output of the photosensor are determined at a plurality of ranges which are smaller than the predetermined range in the former embodiment, and, depending upon the derived distribution of the output of the photosensor, the position to perform ejection is determined.

Figure 8:
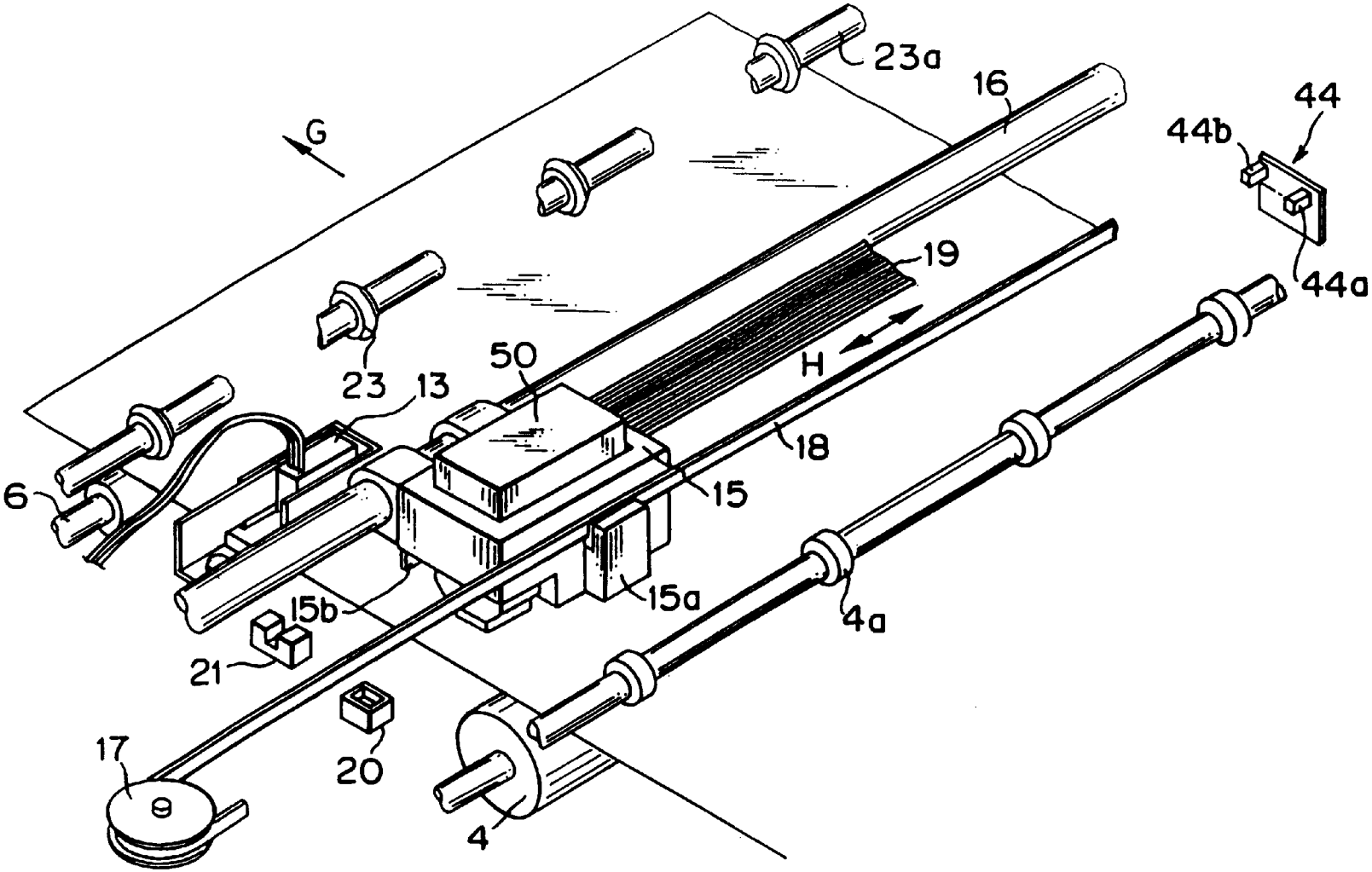
FIG. 8 is a perspective view showing a detailed construction of a second embodiment of a printing portion according to the invention.

The shown embodiment is an application of the present invention for the apparatus similar to the facsimile apparatus shown in FIG. 1. FIG. 8 is a perspective view showing the detail of a printing portion B. Like elements to those in FIG. 2 will be identified by the same reference numerals, and the discussion thereof is neglected for keeping disclosure simple enough.

In the shown embodiment, a detecting sensor 44 has a light emitting element 44*a* and a photo-sensing element 44*b*, as a transmission type photo-interruptive sensor to detect presence and absence of ink by detecting an ink droplet ejected across a light axis therebetween. The detecting sensor 44 is arranged at the opposite side to a portion where a cap 20 is provided, relative to the scanning range of a carriage 15. By arranging the detecting sensor 44 at such position, it becomes possible to avoid staining of the detecting sensor due to discharge of the ink splashed associating with the ejection recovering process.

Figure 9:
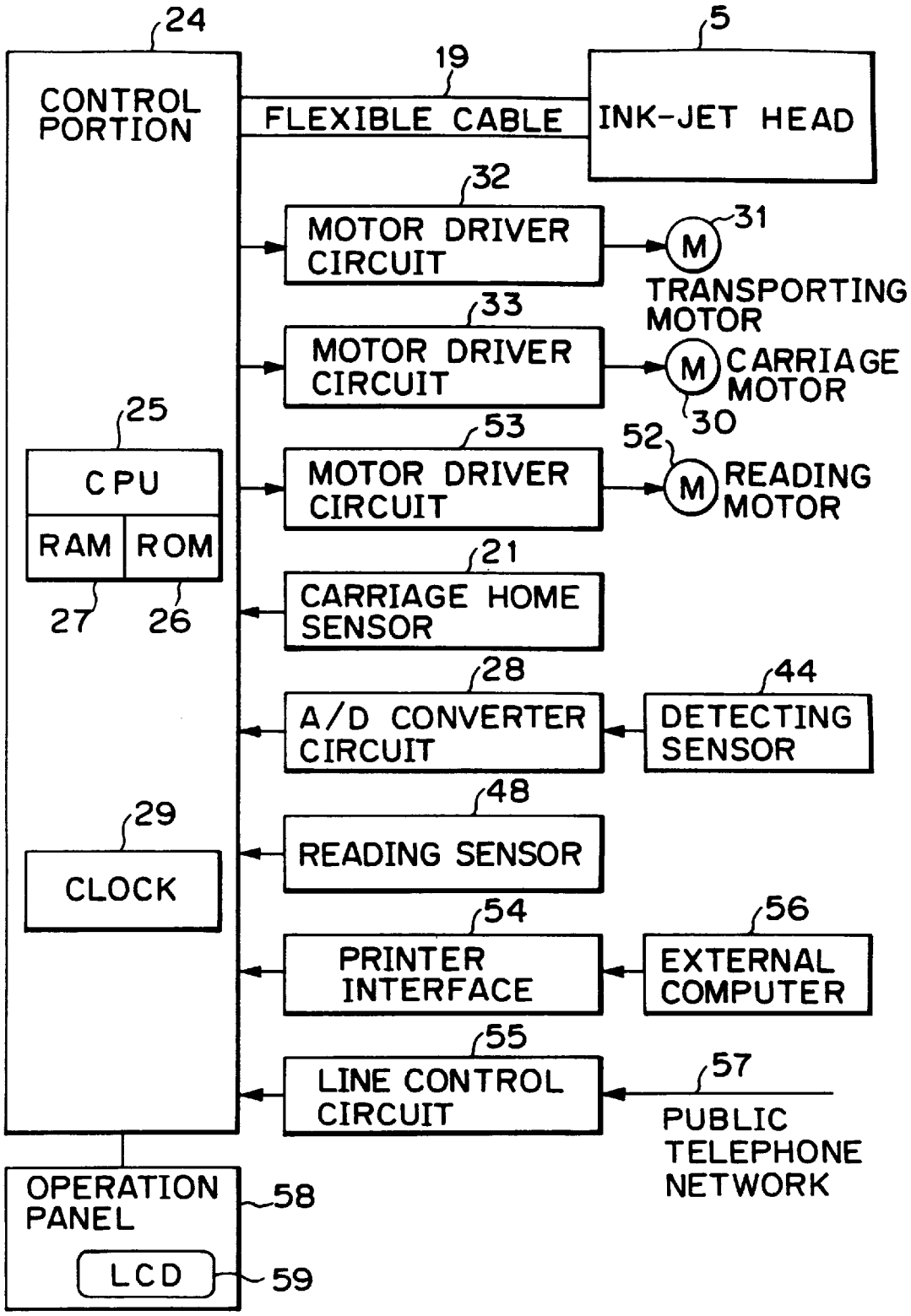
FIG. 9 is a block diagram showing a construction of a control system of the second embodiment of a facsimile apparatus.

FIG. 9 is a block diagram showing a construction of a control system of the shown embodiment of the facsimile apparatus.

In FIG. 9, a reference numeral 24 denotes a control portion for controlling the overall operation of the whole apparatus. The control system 24 has CPU, ROM 26 storing control program and various data and RAM 27 or so forth to be used by CPU 25 as work region in execution of various processes and temporarily storing various data. On the other hand, a part of ROM 26 is formed with EPROM for storing information concerning the ink-jet ejecting position, in operation for detecting the ejection failure which will be discussed later.

The ink-jet head 5 is electrically connected to the control portion 24 via the flexible cable 19. In the flexible cable 19, a control signal line and an image signal line for feeding a control signal and image signal from the control portion 24 to the ink-jet head 5 are included. On the other hand, an output of the detecting sensor 44 is converted into a digital signal by an A/D converter circuit and thus can be processed by CPU 25. A carriage motor 30 is a motor which can be driven for revolution depending upon number of pulse steps supplied from a motor driver circuit 33. Also, the control portion 24 controls the carriage motor 30 via a motor driver circuit 33, a transporting motor 31 via a motor driver circuit 32, and a reading motor 52 via a motor driver circuit 53. The detection output of the carriage home sensor 21 is input to the control portion 24.

The control portion 24 is also connected to an input device of the image data, such as a reading sensor 48, a printer interface 54 for receiving printing instruction and/or printing data from an external computer 56, a line control circuit 55 for receiving reception data from a telephone network 57 and so forth, for operation of facsimile transmission and reception, copying and as a printer of the external computer. Further, the control portion 24 is also connected to an operation panel 58, through which a user of the apparatus performs various operations and enters various commands. In the operation panel 58, an LCD 59 for performing message display is provided.

Figure 10:
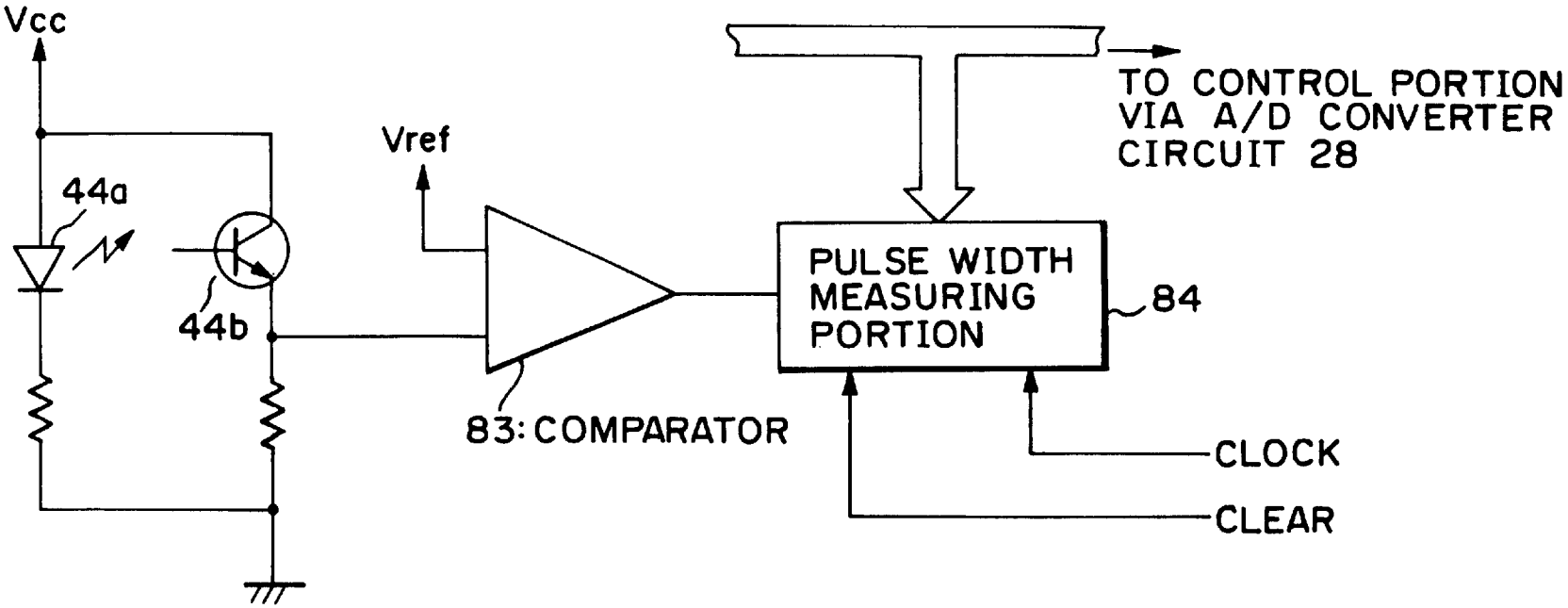
FIG. 10 is a block diagram showing a detailed construction of an ink remaining amount detecting sensor to be employed in the second embodiment.

FIG. 10 is a block diagram showing an electrical construction of the detecting sensor 44.

In FIG. 10, a reference numeral 44*a* denotes an infrared ray LED as the light emitting element, a reference numeral 44*b* denotes a phototransistor as the photosensing element for receiving the infrared light, a reference numeral 83 denotes a comparator for comparing the output of the phototransistor with a predetermined reference voltage (Vref), and a reference numeral 84 denotes a pulse width measuring portion for measuring continuing period (pulse width) of the pulse output from the comparator. The pulse width measuring portion 84 takes the pulse width of a clock (reference clock) input thereto as a reference pulse width and counts a cycle of the reference clock during continuing period of the pulse output from the comparator 83 for outputting the counted value to an internal register of the pulse width measuring portion 84.

In the construction set forth above, when the ink is not ejected from the ink-jet head 5, there is nothing interrupting the infrared light emitted from the infrared ray LED 44*a*. Thus, a high (H) level signal is input to the comparator 83 from the phototransistor 44*b* as the photo-sensing element. In contrast to this, when ink ejection is performed, the ejected ink interrupts infrared light from the infrared ray LED 44*a*, and the output from the phototransistor 44*b* is lowered in a corresponding magnitude to interruption amount of the infrared light. When the output level drops lower than the reference voltage Vref input to the comparator 83, the output signal to the pulse width measuring portion 84 from the comparator 83 is reversed. Subsequently, when ink ejection through the ink-jet head 5 is completed, the output of the phototransistor 44*b* is resumed to be high (H) level to be elevated across the reference voltage Vref set in the comparator 83, so that the output from the comparator 83 to the pulse width measuring portion 84 is reversed again.

Thus, to the pulse width measuring portion 84, a pulse having a pulse width corresponding to the period where the output of the detecting sensor 44 is held below the reference voltage, is input. As set forth above, a width of this pulse is measured or counted utilizing the reference clock and stored in the internal register of the pulse width measuring portion 84. The counted value is read out by CPU 25 of the control portion 84 and is used for detection of ejection failure. In the alternative, it is possible to transfer to and store the counted value indicative of the pulse width in RAM 27 of the control portion 24 and to read out by the CPU 25 after completion of ink ejection.

It should be noted that the clock frequency of the reference clock to be employed in the shown embodiment is approximately 56.5 [1/msec], and a threshold value of judgement whether ink is ejected or not is set at 80 pulses.

Figure 11:
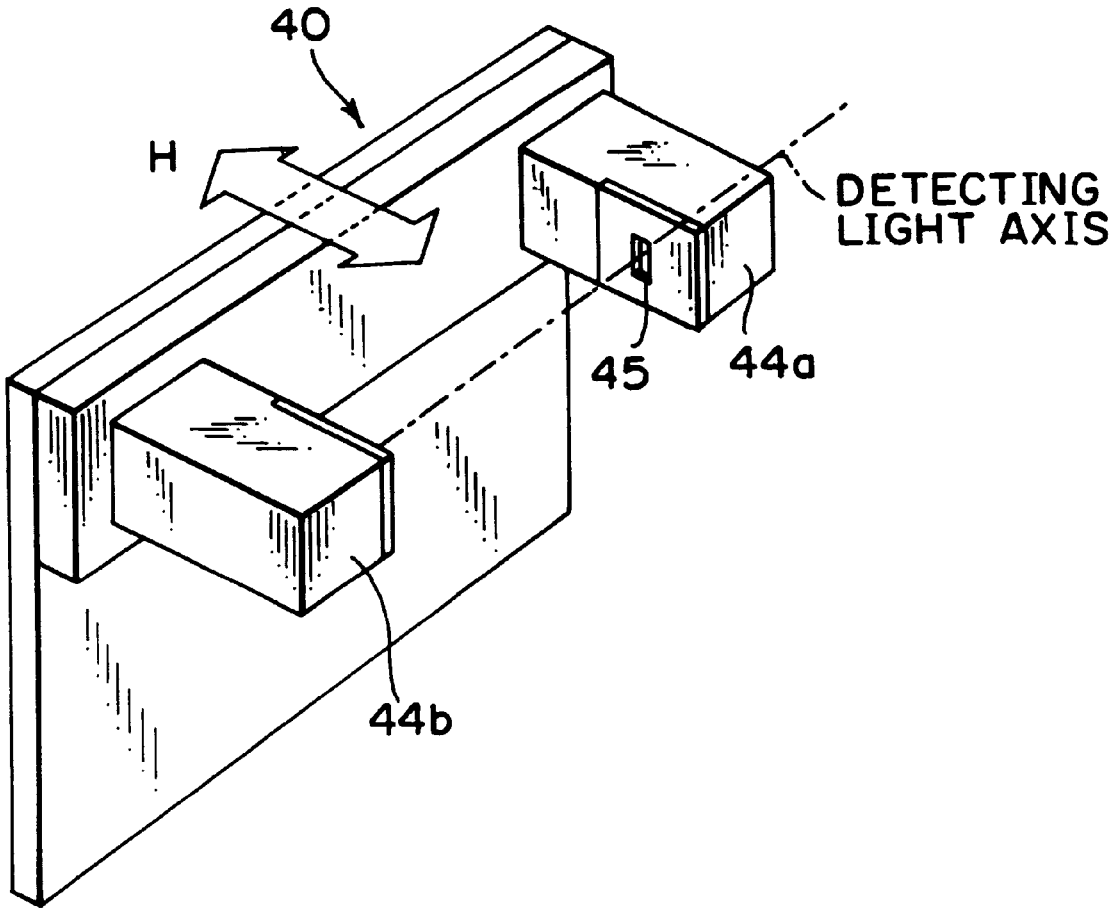
FIG. 11 is a perspective view showing a detailed construction of the ink remaining amount detecting sensor.

FIG. 11 is a perspective view showing a construction of the detecting sensor 44. As shown in FIG. 11, in the shown embodiment, for increasing light interruption rate of the light axis by the ejected ink, slits are provided at a side of the light emitting element 44*a* and at a side of the photo-sensing element 44*b* to enhance precision in detection.

Figure 12:
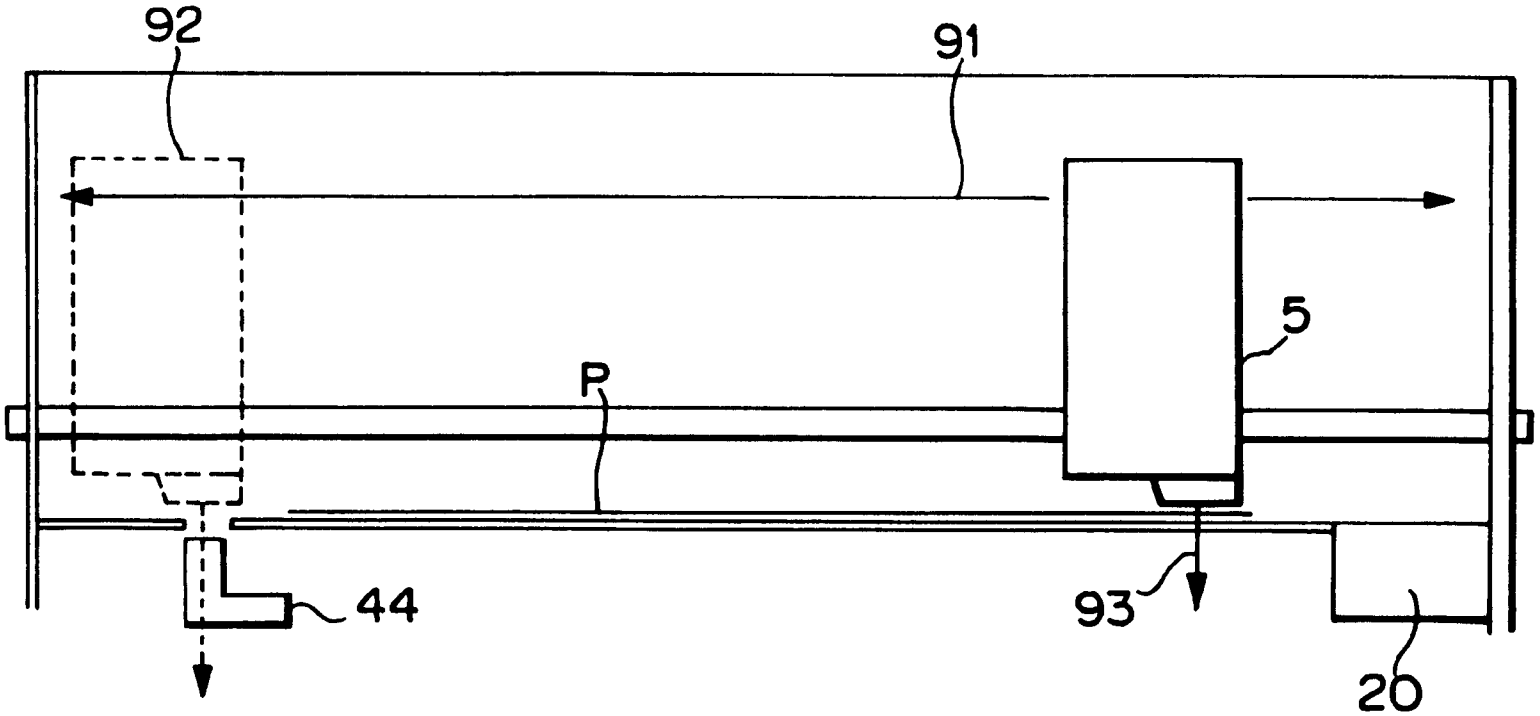
FIG. 12 is an illustration showing a setting position of the ink remaining amount detecting sensor in the facsimile apparatus.

FIG. 12 is an illustration showing a set position of the detecting sensor 44.

In FIG. 12, an arrow designated by a reference numeral 91 shows the range where the ink-jet head may move. In the shown embodiment of the facsimile apparatus, the width of B4 size printing paper is set as a maximum printing width. In addition to the maximum printing width, accelerating and decelerating ranges are provided. Therefore, a maximum width for moving the ink-jet head 5 is 371.9 mm. Further, a reference numeral 92 denotes a position of the ink-jet head, at which detection of ejection failure is performed, and an arrow designated by a reference numeral 93 represents ejecting direction of the ink. In the shown construction, the printing paper P is transferred from the distal side to proximal side in the perpendicular direction to the surface of the paper of the drawing.

Figure 13:
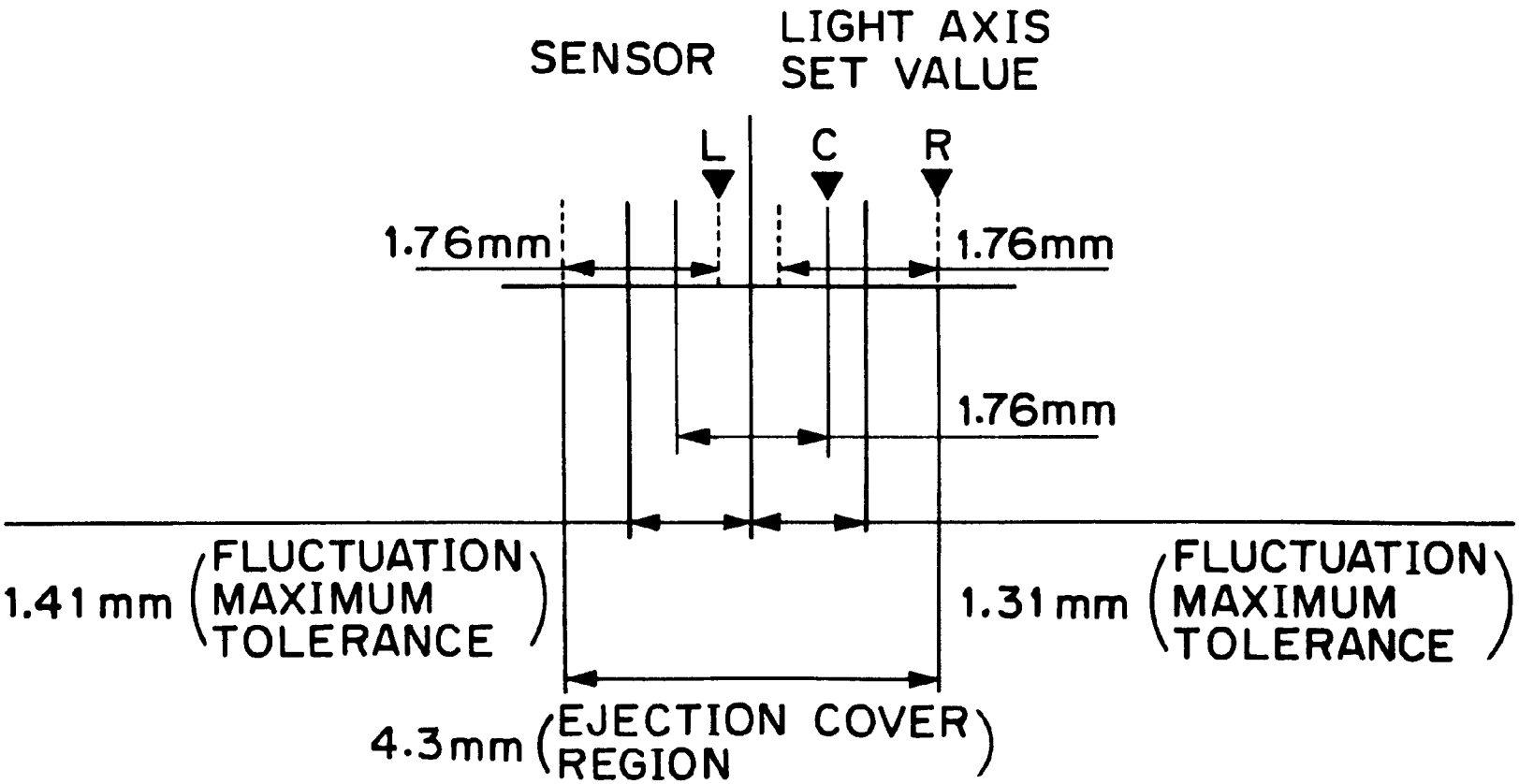
FIG. 13 is an illustration showing a relationship in position between an ink ejecting position and a light axis of the ink remaining amount detecting sensor, for detecting an ink remaining amount.

FIG. 13 is an illustration showing a positional relationship between the ink ejecting position for detecting the ejection failure, as shown in FIG. 12, and the light axis of the detecting sensor which is set as data. In the drawings, with respect to the designed position of the light axis of the detecting sensor 44, three ejection initiating points, points L, C and R, are indicated.

Due to tolerance of the components of the apparatus, dimensional tolerance in assembling of the apparatus, and variation of dimensions due to use environmental condition of the apparatus, the light axis position of the detecting sensor 44 set as data may be relatively deviated with respect to the actual light axis position toward the carriage home sensor 21 or opposite side thereto. Namely, by such variation in dimension, experimentarily, the relative light axis position is frequently deviated in a magnitude of 1.31 mm toward the carriage home sensor or 1.41 mm toward the opposite direction.

Accordingly, in detection of the ejection failure in the prior art, it is required to perform ejection of the ink with moving the ink-jet head in a magnitude of 2.72 mm across the designed light axis position in consideration of this width (2.72 mm) as set forth above.

In such case, assuming that the printing density in the shifting direction of the head 5 is 360 DPI, it becomes necessary to perform about 62 times of ink ejection for respective ejection openings within the range of 2.72 mm. On the other hand, in the prior art, detection of ejection failure is performed every time of completion of printing operation for one sheet of printing paper. Therefore, in order to make it possible to print on 1400 sheets of printing papers on average per one ink cartridge with employing the ink-jet head having 128 ejection openings for monochrome printing, extra amount of ink in the extent of CI=62×128×1400=11110400 becomes necessary.

In contrast to this, in the shown embodiment, upon exchanging of the ink cartridge, detection of ink ejection is performed at three regions having printing initiation points L, C and R at both sides of a designed (nominal) light axis position. The foregoing three points are set at the positions respectively corresponding to 672, 669 and 666 steps in the number of driving pulses of the carriage motor 30. Then, the ink ejection is performed so that respective of the three points L, C and R become the ejection initiation points.

Here, assuming that the ink ejection width in respective of three regions of ink ejection is about 1.76 mm and the printing density in the shifting direction of the ink-jet head 5 is 360 DPI, approximately 40 times of ink ejection becomes necessary. It should be noted that the shifting speed of the carriage 15 is 277 mm/sec.

Then, in the ejection detecting operation performed for three times upon exchanging of the ink cartridge, the position where the level drop of the output from the photosensor 44*b* becomes maximum (position where the output D of the detecting sensor 44 becomes maximum), that is, the position where the ink interrupts the light most efficiently, is taken as the position for ejection in detection of the ejection failure during subsequent actual printing operation. At this time, number of ink ejection is set at the same number for the foregoing detection of ejection to be performed upon exchanging of the ink cartridge.

By this, the ink consuming amount (CI) necessary for detecting ejection failure with respect to one ink cartridge, when the ink-jet head having 128 of ejection openings for monochrome printing is employed, becomes CI=40×128×3+40×128×1400=7183360.

Comparing this with the ink consuming amount in the prior art, the ink consuming amount required for detection of ejection failure is reduced to be approximately 65% of that required in the prior art. Also, upon detection of ejection at exchanging of the ink cartridge, ink ejection is performed over wider range than that in the prior art, and it becomes possible to adapt for unexpectedly large offset of the light axis.

Figure 14:
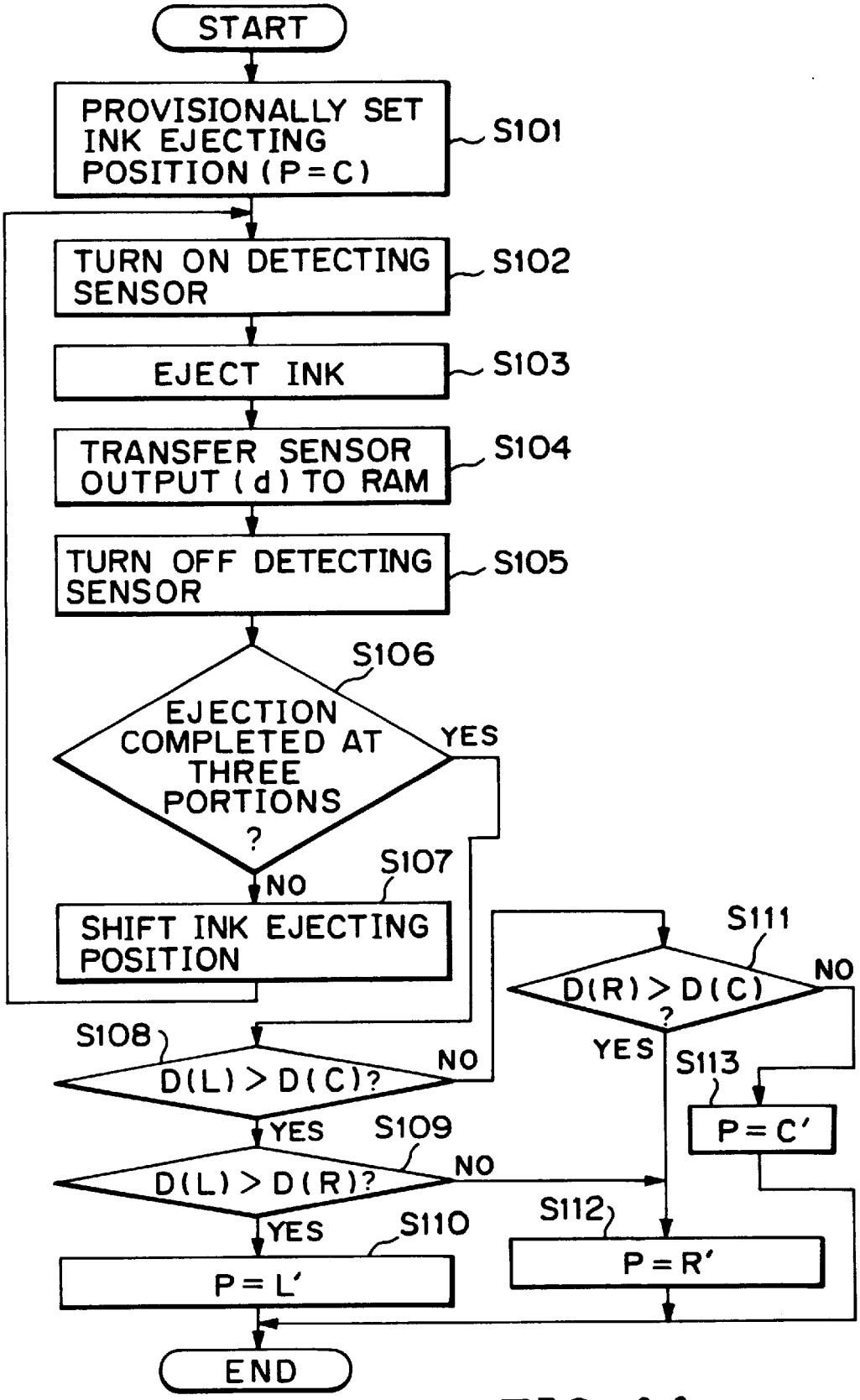
FIG. 14 is a flowchart showing adjusting process of an ink ejecting position for operation for detecting of the ink remaining amount.

Next, discussion will be given for ink ejecting position setting process for ejection failure detecting operation in the construction set forth above, with reference to a flowchart of FIG. 14. The shown process is executed upon exchanging of the ink cartridge.

At first, at step S101, the ink ejecting position (P) for detecting ejection failure is provisionally set at the point C which has been previously set (P=C). Next, at step 102, the detecting sensor 44 is turned ON to cause emission of light from the light emitting element 44*a*. Also, at step S103, with taking the foregoing provisionally set position or other position set in relation to the provisional position, as the ejection initiation position, the ink-jet head 5 is moved within the above-mentioned range and ink ejection is performed for the above-mentioned times (e.g. 25 times). Then, at step S104, the output of the detecting sensor 44 is transferred to RAM 27 of the control portion 24 and stored therein. Thereafter, at step S105, the detecting sensor 44 is turned OFF and light emission of the light emitting element 44*a* is terminated.

At step S106, check is performed if detection process with taking three points L, C, R as the provisionally set position and other positions set in relation to the provisionally set position is completed or not. If judgement is made that process is completed, the process is advanced to step S108, and otherwise, the process is advanced to step S107 for moving the ink-jet head 5 to set the ink ejecting position (P) to the point C or the point L or point R, and then to return the process to step S102. Thus, detection of ink ejection within a range associated with the three points is performed.

Upon completion of detection of ink ejection at three positions, output D(L) obtained by performing detection of ejection with respect to the point L, output D(C) obtained by performing detection of ejection with respect to the point C and output D(R) obtained by performing detection of ejection with respect to the point R are stored in RAM 27.

Subsequently, processes of step S108 and subsequent steps are performed with employing this data.

At step S108, comparison of the outputs D(L) and D(C) is performed. If D(L)>D(C), the process is advanced to step S109 for comparing the outputs D(L) and D(R). Then, if D(L)>D(R), the process is advanced to step S110. As a result, amongst ejecting positions associated with the foregoing three points, the ejecting position L' corresponding to the maximum output relating to the point L is set as the ink ejecting position (P) for detection of ejection failure. Thereafter, the process goes END.

On the other hand, at step S108, if D(L)≦D(C), the process is advanced to step Slll for performing comparison of D(R) and D(C). Here, if D(R)>D(C), the process is advanced to step S112 for setting the ejecting position R' corresponding to the maximum output relating to the point R as the ink ejecting position (P) for detection of ejection failure. Thereafter, the process goes END. On the other hand, if D(R)≦D(C) as checked at step S111, the process is advanced to step S113 for setting the ejecting position C' corresponding to the maximum output relating to the point C which is provisionally set, as the ink ejecting position (P) for detection of ejection failure. Thereafter, the process goes END.

The ink ejecting position for detecting ejection failure determined in the manner set forth above, is effective until next occurrence of exchanging of the ink cartridge. Then, the information of the ink ejecting position thus determined is stored in EPROM.

Accordingly, with the second embodiment discussed above, with respect to offset of the ink ejecting position for detecting ink ejection to be caused due to tolerance of components of the apparatus, dimensional tolerance in assembling of the apparatus, and variation of dimensions due to use environmental condition of the apparatus, correction is performed upon exchanging of the ink jet cartridge, in which the head and the tank are integrated to determine the position for detecting ejection failure at the position where the light from the detecting sensor can be interrupted most effectively. Therefore, more precise detection of ejection failure can be performed.

Further, once the position is determined, the ink ejection amount in detection of ejection failure after completion of actual printing operation can be reduced. Thus, ink consuming amount associated with detection of ejection failure can be reduced so that greater amount of ink can be used for actual printing operation.

While the number of ink ejections upon ejection detection operation is discussed as 25 times, it is possible to use other values as long as not affecting precision in detection. Also, it is possible to vary number of ejections of the ink at every ink ejecting position. Furthermore, the predetermined value is employed in the shown embodiment as threshold value for detection; the present invention should not be specified to the shown arrangement. For example, it is possible to set at a given ratio of the output of the detecting sensor upon detection of ejection which is performed upon exchanging of the ink.

Further, in the shown embodiment, the positions to be candidate points for determining the positions for ejection to be performed upon exchanging of the ink cartridge are three. However, the present invention should not be limited to this. For example, it can be other values, and is not necessary to be always set as the constant value but can be variable. Also, when ink-jet head for monochrome printing and ink-jet head for color printing, when the detection means is provided, ink ejection amount, the ejection frequency, ejecting speed may vary the ink supply amount per respective inks in detection of the ink ejection amount, the number of ink ejections ink ejecting position and offset amount from the design value of the light axis of the sensor may be set separately for respective color inks in detection of ejection.

Further, respective embodiments set forth above have been exemplarily discussed in terms of application for the facsimile apparatus, but the present invention is applicable not only for the facsimile but also in various printing apparatuses employing the ink-jet printing system. It is possible to apply the present invention for an ink-jet printer to be connected to a host apparatus, such as a computer or so forth for outputting image, character and so forth. In such case, it is desirable to perform detection of ejecting condition of the ink by the photosensor in advance of initiation of printing or in advance of initiation of printing per one page. In the facsimile apparatus, since printing is performed with receiving the data transmitted through the telephone network and storing the received data in the memory, whether printing for one page is performed appropriately or not is checked after printing for one page. When inappropriate printing due to occurrence of ejection failure is detected, it is possible to interrupt printing and store data of the relevant page and subsequent pages in the memory for preventing loss of received data. In the printer performing printing with connecting to the host or so forth, it is easy to enter a command for re-output since the user is present in the vicinity of the apparatus. Also, by checking occurrence of ejection failure before printing one page, it is possible to detect ejection failure at earlier timing than checking after printing. By this, it becomes possible to eliminate a period of printing under the condition where the ejection failure occurs. In addition, the printing medium, such as the paper or so forth, can be saved. Therefore, detection of the ejecting condition in advance of printing is desired.

On the other hand, in the facsimile apparatus, there is apparatus having a printing portion which can be used as general printing portion. In such facsimile apparatus, in addition to a terminal for connection with telephone line, a terminal for connection with the computer or so forth is provided so as to achieve both functions as the facsimile apparatus and the printer by manual switching by the user or automatic switching by preferentially outputting the side from which data is transmitted.

Further, while the foregoing embodiments have been discussed for examples to perform monochrome printing with mounting one ink cartridge, in which a tank storing the ink and the printing head are integrated, the present invention is applicable for the printing apparatus mounting a plurality of cartridges corresponding to a plurality of colors of inks to form a color image.

On the other hand, in the facsimile apparatus which can be used as printer as set forth above, it becomes possible to form a black monochrome image when used as the facsimile and to form a color image when used as the printer by a construction exchangeably mounting the cartridge ejecting a single color ink and the cartridge storing a plurality of color inks for color printing. In such construction, it is possible that when the apparatus is used as the facsimile, detection of ejecting condition by the photosensor is performed every time of printing for one page, as set forth above, and when the apparatus is used as the printer, detection of the ejecting condition is not performed. Particularly, when the apparatus is used as the printer, commanding of outputting again is relatively earlier than that in the case of the facsimile apparatus. Therefore, by setting not to perform detection of ejecting condition, ink consumption can be restricted to lower running cost.

Furthermore, in the embodiments as set forth above, the invention is discussed in relation to the facsimile apparatus employing a printing apparatus in which the ink jet cartridge integrally having the head and the ink tank is detachably provided. The present invention is not only applied to this type of the printing apparatus but to printing apparatuses in which the head and the ink tank comprising the ink jet cartridge are provided in a detachable manner from each other, and in which the head and the ink tank are provided seperately. In these constructions of the printing apparatus, in the case that a life of the head is long so that a frequency of exchanging of the head is less than that of the ink tank, the above-described correction operation of the detection position for detecting the ejection failure may be performed for each exchange of the head. On the other hand, in the case that the head of a permanent type is employed, since it is necessary to consider change of ejection position of the head with time, the correction operation may be performed at a predetermined interval or at time when printing of a predetermined amount have been completed.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus employing an ink-jet head having a plurality of ejection openings to perform printing by ejecting ink toward a printing medium, comprising:

a detecting unit having a light emitting element and a photosensing element, said photosensing element outputting a signal in accordance with an interrupted state of a light path formed between said light emitting element and said photosensing element caused by the ejected ink;

moving means for causing relative movement between the ink-jet head and said detecting unit within a moving range;

ejection control means for controlling the ink-jet head to eject the ink while controlling said moving means to cause the relative movement between said detecting unit and the ink-jet head;

detecting range determining means for determining a detecting range in a predetermined range within the moving range, based on a variation of the output signal from said detecting unit upon ejection of the ink from the ink-jet head controlled by said ejection control means, the predetermined range being wider than the detecting range; and ejection condition detecting means for detecting an ejection condition of the ink-jet head based on the output signal from said detecting unit upon ejection of the ink, in the detecting range determined by said detecting range determining means, from the ink-jet head controlled by said ejection control means.

2. An ink-jet printing apparatus as claimed in claim 1, wherein the predetermined range is one moving range, and said ejection control means controls ejection through the ink-jet head during the relative movement by said moving means in the one moving range.

3. An ink-jet printing apparatus as claimed in claim 2, wherein the detecting range includes a point corresponding to the maximum value of the output signal of said detecting unit which varies as the ink-jet head ejects ink during relative movement in the predetermined range.

4. An ink-jet printing apparatus as claimed in claim 3, wherein said ejection control means controls ejection within said predetermined range by employing a part of the ejection openings among the plurality of ejection openings of the ink-jet head.

5. An ink-jet printing apparatus as claimed in claim 1, wherein the predetermined range is a plurality of moving ranges, and said ejection control means controls ejection through the ejection openings during the relative movement by said moving means in respective ranges of the plurality of moving ranges.

6. An ink-jet printing apparatus as claimed in claim 5, wherein the plurality of moving ranges have portions mutually overlapping.

7. An ink-jet printing apparatus as claimed in claim 6, wherein the plurality of said moving ranges are three moving ranges.

8. An ink-jet printing apparatus as claimed in claim 5, wherein said detecting range determining means compares respective maximum values of output signals from said detecting unit with respective moving ranges of the plurality of moving ranges to determine the detecting range.

9. An ink-jet printing apparatus as claimed in claim 1, wherein the ink-jet head generates a bubble in the ink by utilizing thermal energy and ejects the ink upon generation of the bubble.

10. An ink-jet printing apparatus as claimed in claim 1, wherein the light path formed between the light emitting element and the photosensing element of said detecting unit is disposed within the predetermined range.

11. An ink-jet printing apparatus as claimed in claim 1, wherein said ejection condition detecting means effects detection upon power-on of said ink-jet printing apparatus.

12. An ink-jet printing apparatus for performing printing by ejecting ink from an ink-jet head toward a printing medium, comprising:

scanning means for reciprocally scanning the ink-jet head;

ejection control means for controlling the ink-jet head to eject the ink within a scanning region of the ink-jet head scanned by said scanning means;

detecting means, provided on a position faced by the ink-jet head, for detecting an ejection condition of the ink-jet head based on a condition of the ink ejected from the ink-jet head controlled by said ejection control means;

control means for controlling movement of the ink-jet head in a vicinity of a nominal detecting position for detection by said detecting means;

test means for controlling operation of said ejection control means to control the ink-jet head to eject the ink at a plurality of positions in a vicinity of the nominal detecting position; and correcting means for correcting a detecting position of the ink-jet head at which said detecting means performs the detection, based on a detection result obtained by said detecting means detecting the ejection condition of the ink ejected from the ink-jet head controlled by said ejection control means under the control of said test means.

13. An ink-jet printing apparatus as claimed in claim 12, wherein said correcting means includes comparing means for mutually comparing a plurality of results of detection obtained from said detecting means, and determining means for determining a position where a maximum of the plurality of results of detection is obtained as the detecting position for performing detection of ink ejection.

14. An ink-jet printing apparatus as claimed in claim 13, further comprising storage means for storing information relating to the detecting position determined by said determining means.

15. An ink-jet printing apparatus as claimed in claim 14, wherein said storage means comprises an EPROM.

16. An ink-jet printing apparatus as claimed in claim 13, wherein, after correction by said correcting means, said detecting means performs detection of the ejection condition of the ink by controlling ink ejection within a range close to the detecting position determined by said determining means.

17. An ink-jet printing apparatus as claimed in claim 12, wherein said detecting means is provided at an end opposite to a home position of the ink-jet head with respect to a scanning direction of the ink-jet head.

18. An ink-jet printing apparatus as claimed in claim 12, wherein the ink-jet printing head ejects a plurality of color inks for performing color printing, and positions and ink ejecting conditions for operating said detecting means are set separately for each of the plurality of colors by said control means.

19. An ink-jet printing apparatus as claimed in claim 12, wherein said plurality of positions in the vicinity of the nominal detecting position are determined in consideration of dimensional tolerances of components of said apparatus, dimensional tolerances in assembling of said apparatus, variation of dimensions due to use environment of said apparatus and individual production characteristics of the ink-jet head.

20. An ink-jet printing apparatus as claimed in claim 12, wherein the ink-jet head utilizes thermal energy and comprises a thermal energy transducer for generating the thermal energy for supply to the ink.

21. An ink-jet printing apparatus as claimed in claim 12, further comprising an exchangeable ink tank for storing the ink.

22. A facsimile apparatus for performing printing output based on received data by employing an ink-jet head having a plurality of ink-jet openings, comprising:

a detecting unit having a light emitting element and a photosensing element, said photosensing element outputting a signal in accordance with an interrupted state of a light path formed between said light emitting element and said photosensing element caused by ejected ink;

moving means for causing relative movement between the ink-jet head and said detecting unit within a moving range;

ejection control means for controlling the ink-jet head to eject the ink while controlling said moving means to cause the relative movement between said detecting unit and the ink-jet head;

detecting range determining means for determining a detecting range in a predetermined range within the moving range, based on a variation of the output signal from said detecting unit upon ejection of the ink from the ink-jet head controlled by said ejection control means, the predetermined range being wider than the detecting range; and ejection condition detecting means for detecting an ejection condition of the ink-jet head based on the output signal from said detecting unit upon ejection of the ink, in the detecting range determined by said detecting range determining means, from said ink-jet head controlled by said ejection control means.

23. A facsimile apparatus as claimed in claim 22, wherein the detecting range includes a point corresponding to the maximum value of the output signal of said detecting unit which varies as the ink-jet head ejects ink during relative movement in the predetermined range.

24. A facsimile apparatus as claimed in claim 23, wherein said ejection control means controls ejection within said predetermined range by employing a part of the ejection openings among the plurality of ejection openings of the ink-jet head.

25. A facsimile apparatus as claimed in claim 23, wherein the ink-jet head generates a bubble in the ink by utilizing thermal energy and ejects the ink upon generation of the bubble.

26. A facsimile apparatus as claimed in claim 22, wherein a light path formed between the light emitting element and the photosensing element of said detecting unit is disposed within the predetermined range.

27. A facsimile apparatus for performing printing output based on received data employing an ink-jet head having a plurality of ink ejection openings, comprising:

scanning means for reciprocally scanning the ink-jet head;

ejection control means for controlling the ink-jet head to eject the ink within a scanning region of the ink-jet head scanned by said scanning means;

detecting means, provided on a position faced by the ink-jet head, for detecting an ejection condition of the ink-jet head based on a condition of the ink ejected from the ink-jet head controlled by said ejection control means;

control means for controlling movement of the ink-jet head in a vicinity of a nominal detecting position for detection by said detecting means;

test means for controlling operation of said ejection control means to control the ink-jet head to eject the ink at a plurality of positions in a vicinity of the nominal detecting position; and correcting means for correcting the detecting position of the ink-jet head at which said detecting means performs the detection, based on a detection result obtained by said detecting means detecting the ejection condition of the ink ejected from the ink-jet head controlled by said ejection control means under the control of said test means.

28. A facsimile apparatus as claimed in claim 27, further comprising an exchangeable ink tank for storing the ink.

29. A detection position correcting method for an ink-jet printing apparatus employing an ink-jet head having a plurality of ejection openings to perform printing by ejecting ink toward a printing medium, said method comprising the steps of:

providing a detecting unit having a light emitting element and a photosensing element, the photosensing element outputting a signal in accordance with an interrupted state of a light path formed between the light emitting element and the photosensing element caused by the ejected ink;

causing relative movement between the ink-jet head and the detecting unit within a moving range;

controlling the ink-jet head to eject the ink while controlling said moving step to cause the relative movement between the detecting unit and the ink-jet head;

determining a detecting range in a predetermined range within the moving range, based on a variation of the output signal from the detecting unit upon ejection of the ink from the ink-jet head controlled in said ejection controlling step, the predetermined range being wider than the detecting range; and detecting an ejection condition of the ink-jet head based on an output from the detecting unit upon ejecting of the ink in the detecting range determined in said detecting range determining step.

30. A detection position correcting method as claimed in claim 29, wherein the detecting range includes a point corresponding to a maximum value of the output signal of the detecting unit which varies as the ink-jet head ejects ink during relative movement in the predetermined range.

31. A detection position correcting method as claimed in claim 30, wherein in said ejection controlling step ejection is performed within the predetermined range by employing a part of the ejection openings among the plurality of ejection openings of the ink-jet head.

32. A detection position correcting method as claimed in claim 29, wherein the predetermined range comprises a plurality of moving ranges, and in said ejection controlling step ejection is controlled through the ejection openings during the relative movement in respective ranges of the plurality of moving ranges.

33. A detection position correcting method as claimed in claim 32, wherein the plurality of moving ranges have portions mutually overlapping.

34. A detection position correcting method as claimed in claim 33, wherein the plurality of said moving ranges are three moving ranges.

35. A detection position correcting method as claimed in claim 32, wherein, in said detecting range determining step, respective maximum values of output signals from the detecting unit are compared with respective moving ranges of the plurality of moving ranges to determine the detecting range.

36. A detection position correcting method as claimed in claim 29, wherein the light path formed between the light emitting element and the photosensing element of said detecting unit is disposed within the predetermined range.

* * * * *

UNITED STATES PATENT AND TRADEMARK OFFICE

CERTIFICATE OF CORRECTION

PATENT NO. : 6,224,183 B1
DATED : May 1, 2001
INVENTOR(S) : Kono et al.

It is certified that error appears in the above-identified patent and that said Letters Patent is hereby corrected as shown below:

Column 1,
Line 15, "Amongst," should read -- Among them, --.
Line 56, "in" should be deleted.
Line 67, "at" should be deleted.

Column 2,
Line 51, "of the" should be deleted.
Line 56, "ink jet" should read -- ink-jet --.

Column 3,
Line 26, "to" should be deleted.
Line 39, "to" should be deleted.
Line 53, "to" should be deleted.
Line 58, "respective of" should be deleted.
Line 63, "respective" should be deleted.
Line 64, "of" should be deleted.

Column 4,
Line 7, "to" should be deleted.
Line 20, "to" should be deleted.
Line 35, "to" should be deleted.
Line 40, "respective of" should be deleted.
Line 45, "respective" should be deleted.
Line 46, "of" should be deleted.

Column 6,
Line 1, "not be understood as" should read -- be understood as not --.
Line 17, "are" should read -- is --.
Line 38, "of" should be deleted.
Line 60, "of" should be deleted.
Line 63, "with" should read -- by --.
Line 66, "and" should be deleted.

UNITED STATES PATENT AND TRADEMARK OFFICE

CERTIFICATE OF CORRECTION

PATENT NO. : 6,224,183 B1
DATED : May 1, 2001
INVENTOR(S) : Kono et al.

It is certified that error appears in the above-identified patent and that said Letters Patent is hereby corrected as shown below:

Column 7,
Line 15, "to" should be deleted.

Column 8,
Line 53, "interval" should read -- intervals --.

Column 9,
Line 17, "process" should read -- a process --.
Line 21, "portion" should read -- portions --.
Line 30, "to" (first occurrence) should be deleted.
Line 52, "in" (second occurrence) should read -- to --.

Column 10,
Line 11, "providing" should read -- provided --.
Line 20, "Amongst," should read -- Among them, --.
Line 31, "easily" should read -- easy --.

Column 11,
Line 37, "with" should read -- by --.
Line 40, "with" should read -- by --.
Line 59, "with" should read -- while --.
Line 63, "are" should read -- is --.

Column 12,
Line 17, "associating" should read -- associated --.

Column 14,
Line 12, "experimentarily," should read -- experimentally, --.
Line 29, "with" should read -- by --.
Line 42, "in respective of" should read -- with respect to --.
Line 48, "for" should be deleted.
Line 61, "of" should be deleted.

UNITED STATES PATENT AND TRADEMARK OFFICE

CERTIFICATE OF CORRECTION

PATENT NO. : 6,224,183 B1
DATED : May 1, 2001
INVENTOR(S) : Kono et al.

It is certified that error appears in the above-identified patent and that said Letters Patent is hereby corrected as shown below:

Column 15,
Line 14, "with" should read -- by --.
Line 42, "with" should read -- by --.
Line 51, "goes" should read -- goes to --.
Line 58, "goes" should read -- goes to --.
Line 63, "goes" should read -- goes to --.

Column 16,
Line 23, "not affecting" should read -- they not affect --.
Line 42, "ejections" should read -- ejections, --.

Column 17,
Line 21, "for" should read -- to --.
Line 60, "have" should read -- has --.

Signed and Sealed this

Twenty-sixth Day of February, 2002

*Attest:*

*Attesting Officer*

JAMES E. ROGAN
*Director of the United States Patent and Trademark Office*